US012270131B2

(12) United States Patent
Unnewehr et al.

(10) Patent No.: US 12,270,131 B2
(45) Date of Patent: Apr. 8, 2025

(54) THREE-DIMENSIONAL SHOE

(71) Applicant: adidas AG, Herzogenaurach (DE)

(72) Inventors: Rainer Unnewehr, Herzogenaurach (DE); Stefan Tamm, Herzogenaurach (DE); Claudiu-Ionut Popescu, Herzogenaurach (DE)

(73) Assignee: adidas AG, Herzogenaurach (DE)

( * ) Notice: Subject to any disclaimer, the term of this patent is extended or adjusted under 35 U.S.C. 154(b) by 0 days.

(21) Appl. No.: 17/851,791

(22) Filed: Jun. 28, 2022

(65) Prior Publication Data

US 2022/0325447 A1 Oct. 13, 2022

Related U.S. Application Data

(63) Continuation of application No. 16/426,812, filed on May 30, 2019, now Pat. No. 11,408,103.

(30) Foreign Application Priority Data

Jul. 27, 2018 (DE) ..... 10 2018 212 632.1

(51) Int. Cl.

| | |
|---|---|
| ***D04B 1/24*** | (2006.01) |
| ***A43B 1/04*** | (2022.01) |
| ***A43B 23/02*** | (2006.01) |
| ***D04B 21/20*** | (2006.01) |

(52) U.S. Cl.

CPC ..... *D04B 1/24* (2013.01); *A43B 1/04* (2013.01); *A43B 23/025* (2013.01); *D04B 21/207* (2013.01); *D10B 2501/043* (2013.01)

(58) Field of Classification Search

CPC .. A43B 1/04; A43B 23/025; D10B 2501/043; D04B 1/24; D04B 21/207; D04B 1/26; D04B 7/30; D04B 7/32; D04B 9/42; D04B 9/46; D04B 11/28; D04B 11/34

See application file for complete search history.

(56) References Cited

U.S. PATENT DOCUMENTS

| | | | |
|---|---|---|---|
| 3,974,525 | A | 8/1976 | Jansen |
| 6,158,253 | A | 12/2000 | Svoboda et al. |
| 7,992,243 | B2 | 8/2011 | Cook et al. |
| 8,997,529 | B1 | 4/2015 | Podhajny |
| 10,316,441 | B2 | 6/2019 | Ly |
| 10,499,701 | B2 | 12/2019 | Cai et al. |
| 10,631,594 | B2 | 4/2020 | Boucher et al. |

(Continued)

FOREIGN PATENT DOCUMENTS

| | | | |
|---|---|---|---|
| CN | 103653542 | A | 3/2014 |
| CN | 104066350 | A | 9/2014 |

(Continued)

OTHER PUBLICATIONS

Extended European Search Report for EP Application No. 19188635.7 mailed on Jan. 3, 2020, 9 pages.

(Continued)

*Primary Examiner* — Danny Worrell

(74) *Attorney, Agent, or Firm* — Sterne, Kessler, Goldstein & Fox P.L.L.C.

(57) ABSTRACT

A knitted upper for an article of footwear. The knitted upper is formed essentially as a single piece in a three-dimensional knitting process. The knitted upper includes at least one activated shrink yarn.

14 Claims, 12 Drawing Sheets

(56) References Cited

U.S. PATENT DOCUMENTS

Figure 1A:
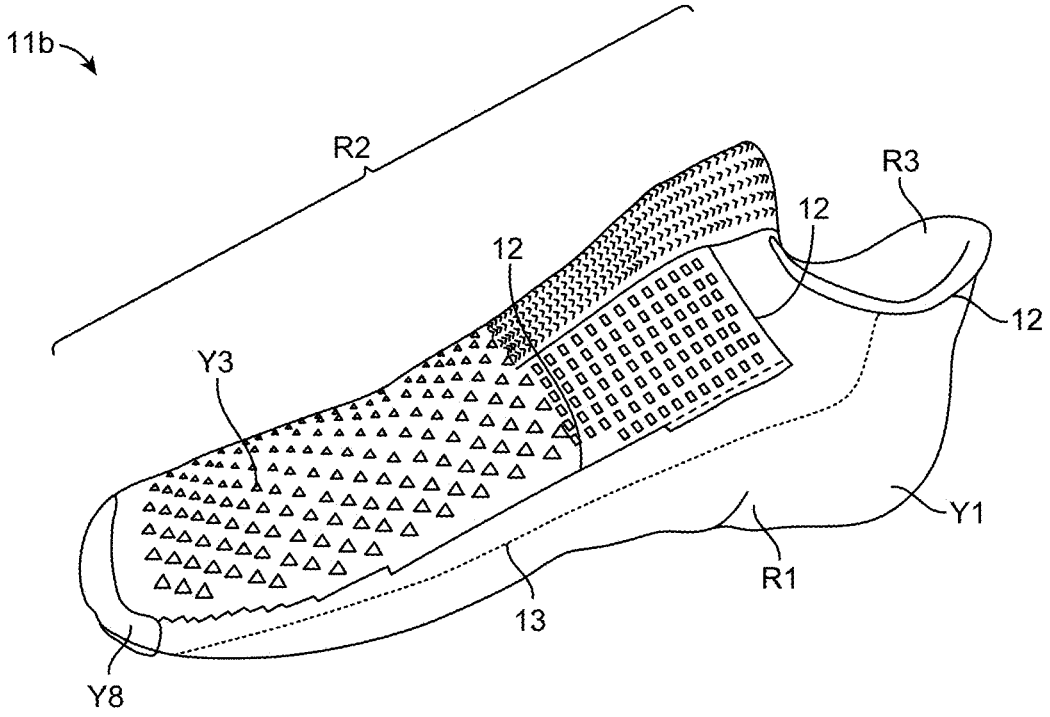

| | | | | |
|---|---|---|---|---|
| 10,745,834 | B2 | 8/2020 | Terai et al. | |
| 2005/0115284 | A1 | 6/2005 | Dua | |
| 2010/0154256 | A1 | 6/2010 | Dua | |
| 2010/0269372 | A1 | 10/2010 | Dua et al. | |
| 2012/0266362 | A1 | 10/2012 | Craig | |
| 2014/0137434 | A1* | 5/2014 | Craig | A43B 23/0215 66/170 |
| 2016/0143394 | A1 | 5/2016 | Kenaka | |
| 2016/0302526 | A1 | 10/2016 | Meir | |
| 2017/0245581 | A1 | 8/2017 | McFarland, II et al. | |
| 2018/0168271 | A1 | 6/2018 | Ly | |
| 2020/0375316 | A1* | 12/2020 | Dealey | A43B 23/025 |

FOREIGN PATENT DOCUMENTS

| | | | |
|---|---|---|---|
| CN | 106235524 | A | 12/2016 |
| CN | 206808792 | A | 12/2017 |
| DE | 10 2012 109 108 | A1 | 3/2014 |
| DE | 10 2013 207 153 | A1 | 10/2014 |
| DE | 10 2013 107 803 | A1 | 1/2015 |
| EP | 2 792 264 | A2 | 10/2014 |
| EP | 2 805 638 | A1 | 11/2014 |
| EP | 2 952 616 | A1 | 12/2015 |
| WO | 2017/033540 | A1 | 3/2017 |

OTHER PUBLICATIONS

Lu, Z., Jiang, G., Cong, H., & Yang, X., "The Development of the Flat-Knitted Shaped Uppers Based on Ergonomics," AUTEX Research Journal, 16(2), 67-74 (Jun. 2016).

Zhenzhixue Gailun; "General Theory of Knitting"; Sun Glu, Zhao Xin; Master Edition-Shanghai: Donghua University Press, 2014.6; ISBN 978-7-5669-0542-0; 12 pages.

* cited by examiner

THREE-DIMENSIONAL SHOE

CROSS-REFERENCE TO RELATED APPLICATION

This application is a continuation of U.S. application Ser. No. 16/426,812, filed May 30, 2019, which claims priority to German Application No. 10 2018 212 632.1, filed Jul. 27, 2018, both of which are incorporated herein by reference in their entireties.

TECHNICAL FIELD

The present invention relates to a knitted upper for an article of footwear, in particular a sports shoe, and a method for manufacturing the same.

PRIOR ART

A shoe generally comprises an upper and a sole attached to it. The upper forms a crucial part of a shoe as it determines the fit, the wearing comfort, and the level of support of wearer's foot. Different parts of the foot require different levels of support or cushioning. For maximum comfort and performance, the properties of an upper need to be engineered locally to provide the right level of support and cushioning for a wearer's foot. However, this represents several manufacturing challenges due to the complexity of manufacturing an upper with several different functional regions. In particular, with traditional manufacturing techniques such as weaving, separate sheets of material with different properties, such as elasticity, would be required for different parts of the upper. To produce an upper, said sheets would have to be sewn together. From a manufacturing point of view, this increases the complexity of the manufacturing process as it adds additional process steps. Moreover, the sewn seams formed between different sheets of material reduce the wearing comfort of a resulting upper and may lead to injuries of a wearer's foot such as blisters.

Knitting allows an upper to be produced as one unitary piece in a single process step. It is known in the prior art that the properties of a knitted upper can be engineered locally by an informed choice of the elasticity of the yarn.

EP 2 792 264 A2 discloses an upper for a shoe comprising at least one first partial area and at least one second partial area which are manufactured as one-piece knitwear, wherein the first partial area comprises a first yarn and the second partial area comprises a second yarn, and wherein the first yarn is more elastic than the second yarn.

However, the number of yarns of different elasticity that can be used for manufacturing an upper is limited by the number of available yarn carriers on a knitting machine. Furthermore, increasing the number of different yarns used for an upper increases the complexity of the knitting process and therefore the knitting time, leading to an increase in the cost of a knitted upper.

EP 2 952 616 A1 concerns a method for producing a planar or spatial knitted fabric with fixing points introduced therein for stabilizing the shape of the knitted fabric, the fixing points being distributed over at least part of the knitted fabric in the form of a net or lattice, and each fixing point is formed by omitting a mesh in the vertical repeat of the knitted fabric.

US 2010/0269372 A1 concerns flat knitting and in particular selectively placing multiple different yarns and/or stitch patterns at multiple different locations in the overall structure during the knitting process.

It is therefore an object of the present invention to provide a knitted upper with improved wearing properties and reduced complexity of production.

The fit of a knitted upper and the support it provides to a foot is often not as good as desired. This is especially true for challenging regions around the toes and around the heel. While it is relatively straightforward to produce a soft "sock-like" knitted upper, introducing regions of stiffness is much more challenging by knitting. It is therefore a further object of the present invention to provide a knitted upper with sufficient level of stiffness in regions that require additional support, such as the heel and the toe regions.

Moreover, another object underlying the present invention is to provide an improved method of shaping and sizing a shoe upper. For example, it would be beneficial if different final sizes of the shoe upper could be produced without needing to modify the knitting process itself.

SUMMARY OF THE INVENTION

The objectives described above are solved by a knitted upper for an article of footwear formed essentially as a single piece in a three-dimensional knitting process and comprising at least one activated shrink yarn.

The upper is formed essentially as a single tubular knitted piece in a three-dimensional knitting process. In this way, the production process is simplified as a single production step can yield a complete upper without the need for additional operations, such as for instance sewing separate knitted pieces together.

Moreover, the knitted upper so obtained may be intended to enclose the foot of a wearer, covering not only the upper but also the bottom part of the foot of a wearer. This helps to provide better support to the foot and to enhance the comfort feeling for the wearer. The upper enclosing the foot of the wearer also allows more effective transfer of the stresses, and in particular the shear stresses, from the upper to the sole and more in general the tooling of the footwear, improving the overall responsiveness of the footwear and enhancing its performance.

The upper comprises at least one activated shrink yarn. A shrink yarn is incorporated in an inactive state into the knitted fabric. In the inactive state, the shrink yarn has a certain length L1, when the shrink yarn is activated, the shrink yarn obtains a new length L2 which is smaller than L1, that is the shrink yarn reduces its length, i.e. shrinks, when it is activated. In case the shrink yarn comprises more than one component, it is sufficient that one of the components of the shrink yarn has the shrinking properties described above to confer to the whole yarn such properties, Preferably, the shrink yarn is capable of shrinking at least 20%, more preferably the shrink yarn is capable of shrinking at least 30%.

The shrink yarn may comprise at least one air-tack yarn. For example, suitable shrink yarn is a yarn of air tack yarn with 40 to 80 denier elastane, also known as Lycra® or Spandex, and 150 to 300 denier polyester with between 3 and 5 plies in each yarn and 48 filaments per yarn. "Air tack yarn" has the usual meaning in this context, that is, air tack yarn is any yarn that is produced by using a stream of air to attach and entangle the filaments.

Further, the air tack yarn may comprise a string of substantially non-stretch yarn (mostly partially oriented yarns (POY), or Nylon) and a string of plain elastic yarn (like elastane, spandex or Lycra). Both yarns are combined together by tacking the elastic yarn to the non-stretch yarn with a repetitive defined distance. The properties of the shrink yarn and in particular the amount of shrinking for the air tack yarn is influenced by parameters such as its composition, e.g. a polymer that it comprises, the texturing method, the denier or tex value, the filament count, the bulkiness, the volume, and crimp of filaments. The shrinking properties of the air-tack yarn are mainly determined by the filament yarn, i.e. by the non-stretch yarn rather than by the elastic yarn.

The properties of the shrink yarn are determined largely by the ratio of elastane to polyester denier values. Preferably, a ratio of the denier values of substantially non-stretch yarn, for example polyester, and elastic yarn, for example elastane, is between 2:1 and 7:1, more preferably between 3:1 and 5:1. This range of values allows a preferable amount of shrinkage to be achieved.

The shrink yarn shrinks upon activation and remains in the activated, that is the shrunk, state.

Usually, activation may happen above a certain threshold temperature by exposing the shrink yarn to heat or heated steam, this is known as heat-setting. Hot steam is a preferred method of activating a shrink yarn as it penetrates deeply and uniformly in between the yarn fibers. It also prevents damage to the dyes in the fabric and hence the colors of fabric treated with hot steam have a more appealing visual appearance than the colors of the fabric that is exposed to dry heat at the same temperature. The shrink yarn remains in the activated state, that is the shrunk state, even after cooling down and when it is no longer exposed to heat or heated steam.

An area comprising the activable shrink yarn may have an area shrinkage of at least 15%, preferably 30%, more preferably 40% under application of saturated water steam at a pressure of 2 bar for 20 seconds. It is to be understood that the temperature of saturated water steam is determined by its pressure. For example, at a pressure of two bar, saturated water steam will have a temperature of approximately 120° C. The temperature of saturated water steam at a particular pressure is well known and tabulated.

The knitted unconsolidated upper may be arranged on a shoe last and lasted. The knitted unconsolidated upper may be fixed to the last by any suitable means of fixing in order to prevent an unintended movement of the upper during the lasting operation. For example, the upper may be fixed on the last by means of a clamp or a tack. The upper is then exposed to heat or heated steam while it is arranged on the last. The shrink yarn is activated and thus shrinks and provides a close fit of the upper to the last, even in challenging regions. In case that hot steam is used to activate the shrink yarn, the upper is then dried, preferably in the controlled environment of a drying oven, preferably while still on the last in order to maintain the provided shape. The upper is then cooled down and removed from the last.

The shrink yarn allows difficult geometric shapes, such as the ones present on a knitted upper for an article of footwear and in particular for a sports shoe, that would be difficult or impossible to obtain in a pure knitting operation, to be formed and consolidated, that is, fixed permanently. The shrink yarn also helps to compensate the imprecisions on the upper that derive from the pure knitting process. The activated shrink yarn, for example a heat-set shrink yarn, also improves the structural strength of the upper in any region into which it has been incorporated, by providing a higher density to the knitted structure. The upper according to the invention, three-dimensionally knitted and incorporating the activated shrink yarn, is therefore particularly suitable for articles of footwear such as sport shoes that need to provide an optimal fit and that are intended to undergo sundry and significant stresses in use.

A shrink yarn also makes it possible to produce more than one size (full or half size) and for instance up to three adjacent sizes of an upper from a single size of a knitted, unconsolidated upper. This simplifies the production process, as a knitted upper and the corresponding knitting model do not have to be generated for every final full or half size of the consolidated upper.

The activated shrink yarn may be arranged at least in a heel and/or a toe portion of the upper. The heel, for instance in particular in the area of the Achilles tendon, and/or toe portion of an upper are, usually, the most difficult regions to shape. Moreover, a foot requires increased levels of support in the heel and/or the toe region. The heel and/or the toe region are also critical regions that determine how well and comfortably an upper fits a wearer's foot.

The activated shrink yarn may be arranged substantially all over the upper.

The upper may be weft knitted. The same yarn or thread could be used substantially all over the upper. This is important since the number of available yarn carriers limits the number of different types of yarn that can be used. Furthermore, by limiting the number of different types of yarn in use, the knitting time can be reduced. The terms "yarn" and "thread" will be used interchangeably herein.

The upper may further comprise at least one melted fuse yarn. A fuse yarn, also known as a melt yarn, is any yarn that comprises a meltable component. An example of a suitable fuse yarn is a yarn of polyamide with a melting temperature of 85° C. In general, preferable fuse yarns may comprise a thermoplastic polymer, like thermoplastic polyester, polyamide and/or thermoplastic polyurethane.

The fuse yarn is generally heated up above its softening point and glass transition temperature until reaching its melting point.

Preferably, the fuse yarn is melted while the upper is arranged on a last as described herein regarding the activation of the shrink yarn.

A fuse yarn is a useful means to permanently fix the shape of a shaped upper. It also provides additional structural strength in regions where this is required.

The melted fuse yarn may be arranged at least in a heel and/or a toe portion of the upper. The heel and/or toe portion of an upper are, usually, the most difficult regions to shape. Moreover, a foot requires increased levels of support in the heel and/or the toe region.

The upper may be produced on a flatbed knitting machine comprising at least two needle beds. A flatbed knitting machine allows a great variety of complex knitting patterns to be incorporated into the knitted fabric. A flatbed knitting machine comprising at least two needle beds allows the upper to be manufactured as one unitary piece in a single knitting operation. Further processing steps, in which separate parts of the fabric have to be sewn together, can therefore be completely avoided. Furthermore, the upper may be essentially seamless, which improves the comfort of the upper. "Essentially seamless" means that different portions of the upper are joined by knitting. The knitted upper therefore, at the end of the knitting process, already has a tubular structure and is configured to surround the foot of a wearer, without the need to perform subsequent stitching steps. Obviously additional elements, such as for example care labels, trademarks elements, identifications tabs, may be sewn in and therefore result in a sewn seam. However, in general, a separate step in which two or more pieces are sewn together is not required. Furthermore, the wearing comfort is improved as sewn seams are substantially absent, and no stitching yarn is required which is different, and often less comfortable.

The knitted upper may comprise the same number of knitted layers substantially all over. For instance, the knitted upper may comprise a double layer substantially all over to provide the desired cushioning and support to each part of the foot of the wearer.

According to a different embodiment, the upper may comprise: a first region comprising a first number of knitted layers, and a second region comprising a second number of knitted layers, wherein the second number of knitted layers is larger than the first number of knitted layers.

The first region and/or the second region may have a linear extent in all directions on the surface of the upper that is significantly larger than a separation of two adjacent loops along a weft direction. By "significantly larger" it is meant in this context, at least a factor of 3 larger, preferably a factor of 5 larger. In other words, the first and/or the second region cover parts of the upper that are significantly larger than the mesh size of the knitted fabric. Therefore, regions of support can be engineered on a scale that is significantly larger than the mesh size of the knitted fabric. This is functional because anatomic features of the foot are significantly larger as a mesh size of the knitted fabric. The terms "mesh" and "loop" are used herein interchangeably.

Since the second number of knitted layers is larger than the first number of knitted layers, the second region is less elastic, stiffer, stronger and more stable than the first region. By choosing the appropriate location for the first and second region it is therefore possible to provide the desired amount of flexibility and support in each particular region of the upper. The first region is preferably located in parts of the upper that require less support and/or more flexibility while the second region is preferably located in parts of the upper that require more support and/or less flexibility. The first region is also advantageous in that it generally adds less weight per unit area than the second region.

In addition to tailoring the number of layers in order to provide the desired support, or as an alternative to it, one or more inlaid yarns may be provided on the knitted layer or layers to improve the firmness of the upper in the area where they are incorporated and to allow better transfer of the movement from the foot of the wearer to the sole and tooling of the footwear. Inlaid yarns are yarns that are fed in advance of the knitting yarn by a separate feeder and that are trapped as almost straight horizontal yarns inside the knitted fabric.

Alternatively, a plurality of floating yarns can be provided on an area of the knitted upper where an improved firmness is desired. The floating yarns are free portions of yarns that are connected to the knitted fabrics at their ends by means of loops or tuck stitches. Differently than the inlaid yarns which significantly limit the stretchability of the knitted fabric, the floating yarns contribute to improving the firmness of the knitted fabric while still allowing a good degree of stretchability.

In particular, inlaid yarns or floating yarns may be provided on the forefoot region of the upper and in particular on the portion of the upper intended to cover the metatarsal area of the foot of the wearer in order to provide the needed support to this area of the foot during walking or running.

The first region may be at least partially located in a bottom region of the upper and/or a heel region of the upper, and the second region may be at least partially located in a top region of the upper.

The bottom region of the upper is attached to a sole when an article of footwear is formed from the upper. Therefore, the primary element that provides structural stability in the bottom region of the upper is the sole. Hence, it is not strictly necessary for the upper to provide structural support in a bottom region of the upper and it could be preferable to provide a smaller number of layers in a bottom region of the upper in order to keep the weight of the shoe as low as possible. For shoes where additional support of the heel region is required, the sole element may extend upwards into a heel region, or alternatively a heel counter could be provided. Alternatively, or additionally the knitted upper may comprise a protrusion of the first region extending from the heel region upwards, which protrusion is folded over the heel region doubling the layers of the knitted fabric on the heel region. A heel counter or a heel padding may also be inserted between the knitted layers. In general, the same explanations that apply for the bottom portion of the upper also apply to the heel region of the upper and thus in order to provide an upper having a lighter weight, a lower number of knitted layers can be provided in the heel region.

The top region of the upper may not always benefit from additional structural elements that reinforce the structural stability of an article of footwear comprising an upper according to the invention. This is in contrast to the bottom region of the upper which is generally provided with additional stability by the sole and in contrast with the heel region of the upper which is generally provided with additional stability by the heel counter. Therefore, the structural stability of the top region of the upper needs to be higher than the structural stability of the bottom region of the upper, in particular when no additional structural elements are provided. It is therefore beneficial to provide a larger number of layers in the top region of the upper than in the bottom region of the upper.

The activated shrink yarn may be arranged at least in the first region and in particular in the bottom and/or heel regions. The bottom and/or heel regions, in fact, comprise the portions of the upper that are more difficult to shape precisely by means of the knitting process alone, like for instance the Achilles tendon area. The final, more precise, shape of the bottom and/or heel regions can hence be more easily achieved by activating the shrink yarn once the upper has been positioned on a last.

Preferably, the activated shrink yarn is arranged substantially all over the upper, allowing a more precise shaping of the entire upper.

At least one of the first region and the second region, i.e. the first and/or second region, may comprise at least two portions, wherein a first portion comprises a yarn of a first type and wherein a second portion comprises a yarn of a second type. This provides an additional way of tuning the properties, in particular the stability, strength, weight, and breathability of the upper. It is to be understood that a type of yarn is not distinguished merely by its thickness, denier or tex value, or by the number of plies it comprises. In other words, two otherwise identical yarns that have a different number of plies or a different thickness or tex value are of a same type. Instead, a type of yarn may be distinguished by the material it comprises or its structure (coated/uncoated) etc.

The knitted upper may comprise at least a first yarn and a second yarn, wherein a number of plies of the second yarn is greater than a number of plies of the first yarn. The advantage is that basic properties of the first and second yarn such as its look, the feel, and the friction are the same but an additional level of stability is provided by the second yarn due to the larger number of plies of the second yarn. The first yarn may be arranged at least in the first portion and the second yarn may be arranged at least in the second portion. Therefore, the second portion may be less elastic and stronger than the first portion.

The number of plies of the second yarn may be at least twice as large as the number of plies of the first yarn. The inventors have discovered that this factor in the number of plies of the second yarn and first yarn, provides the second yarn with a preferred level of increased structural strength while at the same time the first yarn is still sufficiently strong, yet lightweight. For example, the upper may comprise a second yarn comprising two plies of yarn around a rim region of the bottom of the upper and a first yarn comprising a single ply of yarn at a central region of the bottom of the upper. In this way, the rim region, which is subject to greater shear stresses and forces when the upper is being worn, is provided with a stronger construction. The central region, which is subject to lower shear stresses and forces when the upper is being worn and which requires higher flexibility, is provided with a more lightweight construction.

The rim region of the bottom may substantially surround the central region, extending along the lateral and medial edges of the bottom and on at least one of the forefoot and heel areas of the bottom. Alternatively, in order to simplify the knitting process, the rim region and the central region may extend from the forefoot region to the heel region of the bottom parallel to each other along the longitudinal direction of the bottom, with the rim region extending only along the lateral and medial edges of the bottom.

At least one of the first region and the second region, i.e. the first and/or second region, may comprise at least two parts, wherein a first part comprises a first knitting structure and a second part comprises a second knitting structure. The terms "knitting structure" and "knitting patterns" are used interchangeably. A knitting structure is, for example, plain, interlock, jersey, purl, rib knit, Milanese, Raschel, or tricot. These terms have their usual meaning. For example, interlock is a stitch in which loops of a first course are situated on every other wale, e.g. wale 1, 3, 5, etc. Loops of the next course, the second course, are situated on the wales skipped in the first course, e.g. 2, 4, 6, etc. Front and back of the interlock fabric look identical. The surface is smooth and soft to touch and the resulting fabric is strong and wear resistant.

This is an additional way of tuning the properties, in particular the elasticity, stability, strength, weight, and breathability of the upper. It has the advantage that the same yarn and the same number of plies may be used for both of the two parts, which is important because the number of different types of yarn and plies is limited by the number of yarn carriers. However, it is also possible that different types of yarn and different numbers of plies are used for the two parts.

It should be noted that if either of the regions comprises more than one layer, the layers may not be connected. Alternatively, the layers may be connected. The layers may be connected by knitting, for example, within a single knitting operation. Alternatively, the layers may be connected using any other suitable means. For example, the layers may be connected by means of an adhesive or by melting a fuse yarn that was incorporated during the knitting process or by any other suitable means such as sewing.

In any region comprising a number of layers greater than one, the layers may be interconnected. The stability of the knitted fabric is improved by connecting the layers and the risk of the layers tearing apart is greatly reduced. The layers may be connected directly during the knitting process, which has the advantage of forming a very stable connection that does not require any adhesive or fuse yarn. A fuse yarn, otherwise known as melt yarn, is any yarn that comprises a meltable, generally thermoplastic, component.

However, it is also possible that the layers are connected after the knitting process is completed in a second consolidation step. This has the advantage that a greater number of structures can be formed than would be possible during the knitting process. For example, the layers may be connected by means of an adhesive or by melting a fuse yarn that was incorporated during the knitting process or by any other suitable means such as sewing.

The first region may comprise one knitted layer and the second region may comprise two knitted layers. The knitting process is improved if the first region comprises one knitted layer and the second region comprises two knitted layers. This is because the first region can be knitted on only one of the two needle beds, for instance by knitting with every other needle, and the second region can be knitted by using both needle beds, as well as knitting with every needle.

Both regions may comprise the same number of layers. In particular both regions may comprise two knitted layers. When the two knitted layers are interconnected and connected directly during the knitting process, each region is knitted using both needle beds. This requires some of the needles on each of the needle beds to be maintained free while knitting one of the regions, in order to be used during the knitting of the other region. For instance, each region is knitted using one needle and skipping two needles in each of the needle beds.

Due to the fact that the needles that are knitting each of the regions are located farther from each other, the final knitted structure may be looser than the knitted structure that would be obtained by using all of the needles.

In order to render the knitted structure tighter, a spacer knit structure may be realized on each region by using an elastic yarn having the function of pulling the knitted wales closer to each other.

The invention further concerns a shoe comprising: an upper as described herein, and a sole. The upper has the advantages described herein, in particular it has improved wearing properties, improved fit and improved support enclosing the foot of a wearer and covering not only the upper but also the bottom part of the foot of a wearer. The upper is moreover lightweight and easy to produce. However, the bottom of the upper is relatively soft as it is primarily composed of knitted fabric. Therefore, to provide additional protection of the foot it is necessary to add a sole for certain applications in order to protect the foot from being injured by, for example, sharp objects such as splinters, shattered glass, or sharp stones. However, it is also possible that an article of footwear is manufactured without attaching a sole. Such an article of footwear is particularly lightweight and breathable and could be especially useful for indoor usage where the foot is at a reduced risk of being injured by sharp objects.

The upper enclosing the foot of the wearer also allows a more effective transfer of the stresses, and in particular the shear stresses, from the upper to the sole and more in general the tooling of the footwear, improving the overall responsiveness of the footwear and enhancing its performance.

The invention further concerns a method of producing a knitted upper for an article of footwear, comprising knitting at least one activable shrink yarn into the upper, knitting the upper essentially as a single piece in a three-dimensional knitting process, arranging the knitted upper on a shoe last, and activating the shrink yarn.

The upper is hence formed essentially as a single tubular knitted piece in a three-dimensional knitting process. In this way, the production process is simplified as a single production step can yield a complete upper without additional operations, for example sewing separate pieces together. Moreover, the amount of waste created in the production of the upper according to the present invention is drastically reduced if not almost completely eliminated.

The upper further comprises at least one activable shrink yarn. A shrink yarn is incorporated in an inactive state into the knitted fabric. The knitted fabric comprising the shrink yarn in the inactive state has a certain area A1, when the shrink yarn is activated, the knitted fabric obtains a new area A2 which is smaller than A1, that is the knitted fabric reduces its area, i.e. shrinks, when the shrink yarn is activated. Preferably, the knitted fabric comprising the shrink yarn is capable of an area shrinking between 15% and 45%.

The activable shrink yarn may comprise at least one air-tack yarn. For example, suitable shrink yarn is a thread of air tack yarn with 40 to 80 denier elastane, also known as Lycra® or Spandex, and 150 to 300 denier polyester with between 3 and 5 plies in each thread and 48 filaments per yarn. Air tack yarn has the usual meaning in this context, that is, air tack yarn is any yarn that is produced by using a stream of air to entangle and attach the filaments. The properties of the shrink yarn are determined largely by the ratio of elastane to polyester denier values. The more polyester is present, the greater the shrinkage. Preferably, a ratio of substantially non-stretch yarn, for example polyester, and elastic yarn, for example elastane, is between 2:1 and 7:1, more preferably between 3:1 and 5:1. This range of values allows a preferable amount of shrinkage to be achieved.

Usually activation may happen above a certain threshold temperature by exposing the shrink yarn to heat or heated steam, other suitable energy source may however be used in order to activate the shrink yarn. The shrink yarn remains in the activated state, that is the shrunk state, even after cooling down and when it is no longer exposed to heat or heated steam.

The shrink yarn allows difficult geometric shapes, that would be difficult or impossible to obtain in a pure knitting operation, to be formed and consolidated. The activated shrink yarn also, by increasing the density of the knitted fabric, improves the structural strength of the upper in any region into which it has been incorporated.

A shrink yarn also makes it possible to produce up to three adjacent sizes or half sizes of an upper from a single size of a knitted, unconsolidated upper. The sizes can be measured in a UK, US, or European unit system. This simplifies the production process, as a knitted upper and the corresponding knitting model do not have to be generated for every final full or half size of the consolidated upper.

The method may further comprise knitting at least one fuse yarn into the upper, as better specified below.

The method further comprises arranging the upper on a shoe last and heating the upper in order to at least activate the shrink yarn. The shrink yarn is activated and thus shrinks while the upper is on the last and therefore facilitates a close fit of the upper to the last, even in challenging regions, like for instance the Achilles tendon region.

When the upper comprises a fuse yarn, during heating of the upper, the fuse yarn is melted. The upper is then cooled down to consolidate the lasted shape and then removed from the last. The fuse yarn is preferably melted in the same process step as the shrink yarn is activated to reduce the number of process steps. However, it is possible that the operations of melting the fuse yarn and activating the shrink yarn are performed separately, for example, if the activation temperature of the shrink yarn is different to the melting temperature of the fuse yarn. This may be beneficial to allow a partial consolidation of the upper and further processing steps.

The method may further comprise pre-steaming the upper before arranging it on a shoe last in order to soften the knitted fabric of the upper and allow the upper to be more easily arranged on the last.

Heating the upper may comprise the use of hot steam. In this case, an additional step of drying the upper may be required, preferably in the controlled environment of a drying oven. It is also possible to cool the upper on the last first, remove the upper from the last, and then dry the upper after it has been removed from the last. It is also possible that the upper is dried while it is still on the last, either before a first cool down or after it has cooled down once or several times already. Hot steam is a preferred method of activating a shrink yarn as it penetrates deeply and uniformly into the fabric and the yarn fibers. It also prevents damage to the dyes in the fabric and hence the colors of fabric treated with hot steam have a more appealing visual appearance than the colors of the fabric that is exposed to dry heat at the same temperature.

The knitted upper may be heated by applying to the upper saturated water steam at a pressure between 1 bar and 5 bar for a time interval between 10 seconds and 20 seconds. In particular, the knitted upper placed on a shoe last may be arranged in a steam chamber, where saturated steam is introduced. The saturated steam, introduced in the steam chamber at a temperature preferably between 85° C. and 150° C., penetrates into the yarn fibers of the knitted upper and activates the shrink-yarn. The actual temperature measured on the steamed upper is lower than the temperature of the steam introduced in the steam chamber due to the cooling effect of the last on the upper.

Preferably, when activating the shrink yarn by applying steam to the upper, i.e. by introducing in the steam chamber where the upper arranged on the shoe last is placed, saturated water steam at a pressure of 2 bar for 20 seconds, an area of the upper comprising the activable shrink yarn has an area shrinkage of at least 15%, preferably 30%, more preferably at least 40%.

The method may further comprise fixing the upper with a means of fixing during heating. The knitted unconsolidated upper may be fixed to the last by any suitable means of fixing in order to prevent an unintended movement of the upper during the heating of the knitted upper, the activation of the shrink yarn, and the melting of the fuse yarn if the latter is included in the upper. For example, the upper may be fixed on the last by means of a clamp or a tack.

The activable shrink yarn may be arranged during the knitting process at least in a heel and/or a toe portion of the upper. The heel and/or toe portion of an upper are, usually, the most difficult regions to shape. The heel and/or the toe region are also critical regions that determine how well and comfortably an upper fits a wearer's foot.

As above specified, the method may further comprise knitting a fuse yarn into the upper. A fuse yarn, otherwise known as melt yarn, is any yarn that comprises a meltable, generally thermoplastic, component. There are essentially three types of fuse yarns: a thermoplastic yarn surrounded by a non-thermoplastic yarn; a non-thermoplastic yarn surrounded by thermoplastic yarn; and pure fuse yarn of a thermoplastic material.

After being heated above its softening point, the fuse yarn starts softening and, once the melting temperature is reached, it fuses with the remaining yarns (e.g. polyester or nylon), stiffening the knitwear. The melting temperature of the thermoplastic yarn is determined accordingly and it is usually lower than that of the remaining yarns. For example, a thread comprising two plies of polyamide yarn with a melting temperature of 85° C. and 840 dtex is a suitable fuse yarn.

A fuse yarn is a useful means to permanently fix the shape of a shaped upper. It also provides additional structural strength in regions where this is required. It is particularly useful to control or limit the shrinkage caused by activating a shrink yarn.

The melted fuse yarn may be arranged at least in a heel and/or a toe portion of the upper. The heel and/or toe portion of an upper are, usually, the most difficult regions to shape and the regions that most need to maintain the shape that has been conferred to them. Moreover, a foot requires increased levels of support in the heel and/or the toe region.

The method for producing the upper may comprise weft knitting or warp knitting, although as previously specified the upper is preferably weft knitted.

The upper may be produced on a flatbed knitting machine comprising at least two needle beds. A flatbed knitting machine allows a great variety of complex knitting patterns to be incorporated into the knitted fabric. A flatbed knitting machine comprising at least two needle beds allows the upper to be manufactured in a three-dimensional shape as one unitary piece in a single knitting operation. Further processing steps, in which separate parts of the fabric have to be sewn together, can therefore be completely avoided. Furthermore, the upper may be knitted to be substantially seamless, which improves the comfort of the upper.

When the three-dimensional upper is knitted on a flatbed knitting machine comprising two needle beds, according to the tubular knitting technique, during the knitting there is a transfer of yarns from a first needle bed to a second needle bed when changing a knitting stroke direction and such transfer defines, on the finished upper, a parting line. Preferably, the parting line is arranged between a bottom and a top region of the upper.

This ensures an improved aesthetic appearance of the upper and hence of the shoe since the parting line is arranged at the junction of the upper with the mid-sole or close to it, and allows also a more comfortable wearability when compared with a shoe upper having the parting line arranged along the longitudinal direction of the upper, on the middle of the bottom and top regions.

While knitting the tubular three-dimensional upper on the flatbed knitting machines, the bottom region and the top region of the upper are knitted substantially simultaneously, i.e. a new row of the bottom region may be knitted during one knitting stroke and a new row of the top region may be knitted during the subsequent knitting stroke, so that the bottom region and the top region may grow along the wale direction substantially simultaneously.

In order to provide to the upper the heel shape, partial knitting is preferably performed on the heel portion of the bottom region. During the partial knitting of the bottom region, a plurality of knit strokes may be used to knit only the bottom region, while the top region may be held on needles of the corresponding needle bed.

The method of producing a knitted upper for an article of footwear may further comprise: knitting a first region comprising a first number of knitted layers, and knitting a second region comprising a second number of knitted layers, wherein the second number of knitted layers is larger than the first number of knitted layers.

The first region and the second region of the upper may be knitted substantially simultaneously, i.e. the first and the second regions may grow along the wale direction substantially simultaneously.

The first region and/or the second region may have a linear extent in all directions on the surface of the upper that is significantly larger than a separation of two adjacent loops along a course direction. By "significantly larger" it is meant in this context, at least a factor of 3 larger, preferably a factor of 5 larger. In other words, the first and/or the second region cover parts of the upper that are significantly larger than the mesh size of the knitted fabric. Therefore, regions of support can be engineered on a scale that is significantly larger than the mesh size of the knitted fabric. This is functional because anatomic features of the foot are significantly larger than a mesh size of the knitted fabric.

During the knitting, the yarns may be manipulated on the needle beds to form a tubular knitted structure so as to create an essentially seamless knitted upper. The knitted upper therefore, at the end of the knitting process, already has a tubular structure and is configured to surround the foot of a wearer, without the need to perform subsequent stitching steps. Obviously additional elements, such as for example care labels, trademarks elements, identifications tabs, may be sewn in and therefore result in a sewn seam. However, in general a separate step in which two or more pieces are sewn together is not required. Furthermore, the wearing comfort is improved as sewn seams are substantially absent, and no stitching yarn is required which has different, and often less comfortable properties than the fabric.

It should be noted that if either of the regions comprises more than one layer, the layers may not be connected or may be connected only at one or more of their edges. Alternatively, the layers may be connected. The layers may be connected by knitting, for example, within a single knitting operation. For example, when one of the regions comprises two layers, the layers may be created during a single knitting operation as a double-jersey or a double-layer jacquard. Alternatively, the layers may be connected using any other suitable means. For example, the layers may be connected by means of an adhesive or by melting a fuse yarn that was incorporated during the knitting process or by any other suitable means such as sewing.

The method may further comprise interconnecting the layers in any region comprising a number of layers greater than one. The stability of the knitted fabric is improved by connecting the layers and the risk of the layers tearing apart is greatly reduced. The layers may be connected directly during the knitting process, which has the advantage of forming a very stable connection that does not require any adhesive or fuse yarn. A fuse yarn, otherwise known as melt yarn, is any yarn that comprises a meltable component. However, it is also possible that the layers are connected after the knitting process is completed in a second consolidation step. This has the advantage that a greater number of structures can be formed than would be possible during the knitting process without excessively increasing the knitting time. For example, the layers may be connected by means of an adhesive or by melting a fuse yarn that was incorporated during the knitting process or by any other suitable means such as sewing.

Since the second number of knitted layers is larger than the first number of knitted layers, the second region is less elastic, stiffer, stronger, and more stable than the first region. By choosing the appropriate location for the first and second region it is therefore possible to provide the desired amount of flexibility and support in each particular region of the upper. The first region is preferably located in parts of the upper that require less support and/or more flexibility while the second region is preferably located in parts of the upper that require more support and/or less flexibility. The first region is also advantageous in that it generally adds less weight per unit area than the second region.

In addition to tailoring the number of layers in order to provide the desired support, one or more inlaid yarns may be provided on the knitted layer or layers to improve the stiffness of the upper in the area where they are incorporated and achieve the desired properties of the upper in the different regions like stretch, recovery, elongation, compression and support.

Alternatively, a plurality of floating yarns can be provided on an area of the knitted upper where an improved stiffness is desired, as previously specified.

The first region, comprising a smaller number of knitted layers, may be at least partially located in a bottom region of the upper and/or a heel region of the upper and the second region, comprising a larger number of knitted layers, may be located in a top region of the upper.

The bottom region of the upper is attached to a sole when an article of footwear is formed from the upper. Therefore, the primary element that provides structural stability in the bottom region of the upper is the sole. Hence, it is not necessary for the upper to provide structural support in a bottom region of the upper. In order to lower the weight of the shoe the smallest number of layers may be provided in a bottom region of the upper as well as in a heel region. For shoes, where additional support of the heel region is required, the sole element may extend upwards into a heel region, or alternatively a heel counter could be provided. Alternatively, or additionally the knitted upper may comprise a knitted protrusion of the first region extending from the heel region upwards, which knitted protrusion is folded over the heel region doubling the layers of the knitted fabric on the heel region. A heel counter or a heel padding may also be inserted between the knitted layers.

The top region of the upper does not always benefit from additional structural elements that reinforce the structural stability of an article of footwear comprising an upper according to the invention. This is in contrast to the bottom region of the upper which is generally provided with additional stability by the sole or the heel region which is generally provided with additional stability by the heel counter. Therefore, the structural stability of the top region of the upper needs to be higher than the structural stability of the bottom region of the upper. It is therefore beneficial to provide a larger number of layers in the top region of the upper than in the bottom region of the upper.

The same yarn or thread could be used for knitting the first region and the second region. This is important since the number of available yarn carriers limits the number of different types of yarn that can be used. Furthermore, by limiting the number of different types of yarn in use, the knitting time can be reduced. The terms "yarn" and "thread" will be used interchangeably.

At least one of the first region and the second region, i.e. the first and/or second region, may comprise at least two portions, wherein a first portion comprises a yarn of a first type and wherein the second portion comprises a yarn of a second type. This provides an additional way of tuning the properties, in particular the stability, strength, weight, and breathability of the upper. It is to be understood that a type of yarn is not distinguished merely by its thickness, denier or tex value, or by the number of plies it comprises. In other words, two otherwise identical yarns that have a different number of plies or a different thickness or tex value are of a same type. Instead, a type of yarn may be distinguished by the material it comprises or its structure (coated/uncoated) etc.

Alternatively, the first portion and the second portion may comprise the same yarn having different numbers of plies.

At least a first yarn and a second yarn may be knitted into the upper, wherein a number of plies of the second yarn is greater than a number of plies of the first yarn. The advantage is that basic properties of the first and second yarn such as its look, the feel, and the friction are the same but an additional level of stability is provided by the second yarn due to the larger number of plies of the second yarn. The first yarn may be arranged at least in the first portion and the second yarn may be arranged at least in the second portion. Therefore, the second portion may be less elastic and stronger than the first portion.

The first yarn and the second yarn may both be knitted into the bottom region of the upper arranged on different areas. In particular, the first yarn having a lower number of plies may be knitted into a central area of the bottom region and the second yarn having a greater number of plies may be knitted into longitudinal areas at the sides of the central area. This ensures a sufficient stretchability of the central area and a sufficient support of the longitudinal areas at the sides of the central area.

The number of plies of the second yarn may be at least twice as large as the number of plies of the first yarn. The inventors have discovered that this factor in the number of plies of the second yarn and the first yarn, provides the second yarn with a preferred level of increased structural strength while at the same time the first yarn is still sufficiently strong, yet lightweight. For example, as above specified, the upper may comprise a yarn comprising two plies around a rim region of the bottom of the upper and a yarn comprising a single ply at a central region of the bottom of the upper. This way, the rim region, which is subject to greater shear stresses and forces when the upper is being worn, is provided with a stronger thread. The central region, which is subject to lower shear stresses and forces when the upper is being worn, is provided with a more lightweight construction.

At least one of the regions may comprise at least two parts, wherein the first part comprises a first knitting structure and the second part comprises a second knitting structure. The terms knitting structure and knitting patterns are used interchangeably. A knitting structure is, for example, plain, interlock, jersey, purl, rib knit, Milanese, Raschel, or tricot. These terms have their usual meaning. For example, interlock is a stitch in which loops of a first course are situated on every other wale, e.g. wale 1, 3, 5, etc. Loops of the next course, the second course, are situated on the wales skipped in the first course, e.g. 2, 4, 6, etc. Front and back of the interlock fabric look identical. The surface is smooth and soft to touch and the resulting fabric is strong and wear resistant.

This is an additional way of tuning the properties, in particular the elasticity, stability, strength, weight, and breathability of the upper. It has the advantage that the same yarn and the same number of plies may be used for both of the two parts, which is important because the number of different types of yarn is limited by the number of yarn carriers. However, it is also possible that different types of yarn or different plies for the same type of yarn are used for the two parts.

The first region may comprise one knitted layer and the second region may comprise two knitted layers. In particular, as above specified, the first region may correspond to the bottom region of the upper and the second region may correspond to the top region of the upper. The knitting process and the fit of the resulting upper is improved if the first region comprises one knitted layer and the second region comprises two knitted layers. This is because the first region can be knitted by engaging a lower number of needles on the two needle beds than the number of needles that needs to be engaged for knitting the second region, so that a greater number of needles can be used for knitting the second region, i.e. the top region of the upper remaining visible on the assembled shoe and which needs to provide a stronger support to the foot of the wearer. Therefore, the fit and the appearance of the upper are improved by the fact that not too many needles are skipped in the knitting process of the second region.

The method may further comprise knitting at least two uppers simultaneously on the same knitting machine. Since the knitting time is an important factor that determines the cost of production, it is important to reduce the knitting time as much as possible. Knitting two uppers at the same time allows the knitting time per upper to be reduced by approximately 30%.

The method may also comprise a customization of the shoe last onto which the upper needs to be placed for activating the shrink yarn and hence be shaped and sized. The last may be at least partially based on a customized model of an athlete's foot. In order to do so, the feet of the athlete may be scanned, and a pair of lasts may be produced according to the scanning data retrieved. In particular the pair of lasts may be produced by means of rapid prototyping techniques, as for instance 3D printing.

The customization of the shoe last, together with the fact that the final size and shape of the knitted upper is provided by the activation of the shrink yarn on the customized last, helps to obtain in a simple and economical manner fully customized shoe uppers.

Therefore, the three-dimensional uppers are normally knitted as above described, without being customized for a specific user or athlete during the knitting process and only subsequently, thanks to the shaping and sizing obtained during the activation of the shrink yarn knitted into the upper, are shaped onto a customized shoe last obtained as above described.

SHORT DESCRIPTION OF THE FIGURES

In the following, the invention will be described in more detail with reference to the following figures. These figures show:

FIGS. 1A, B: an exemplary upper according to the invention.

Figure 2A:
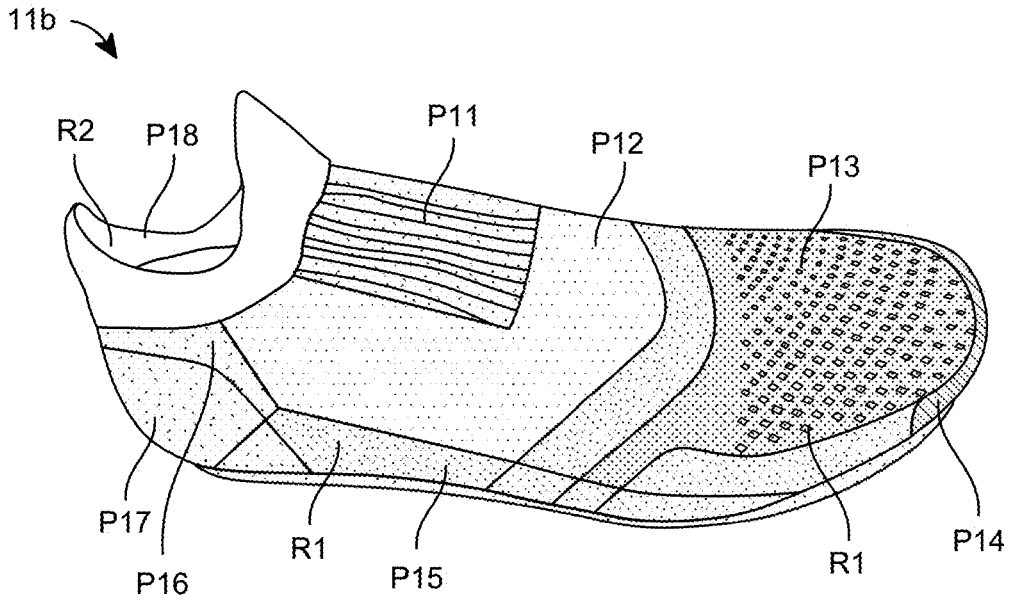

FIGS. 2A, B: another exemplary upper according to the invention.

Figure 3A:
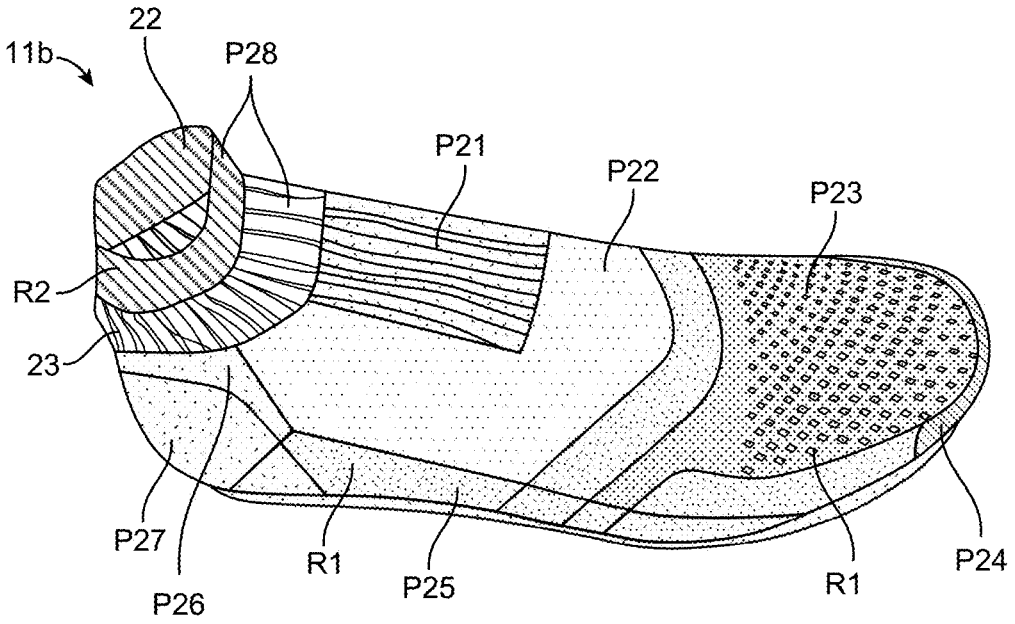

FIGS. 3A, B: another exemplary upper according to the invention.

Figure 4A:
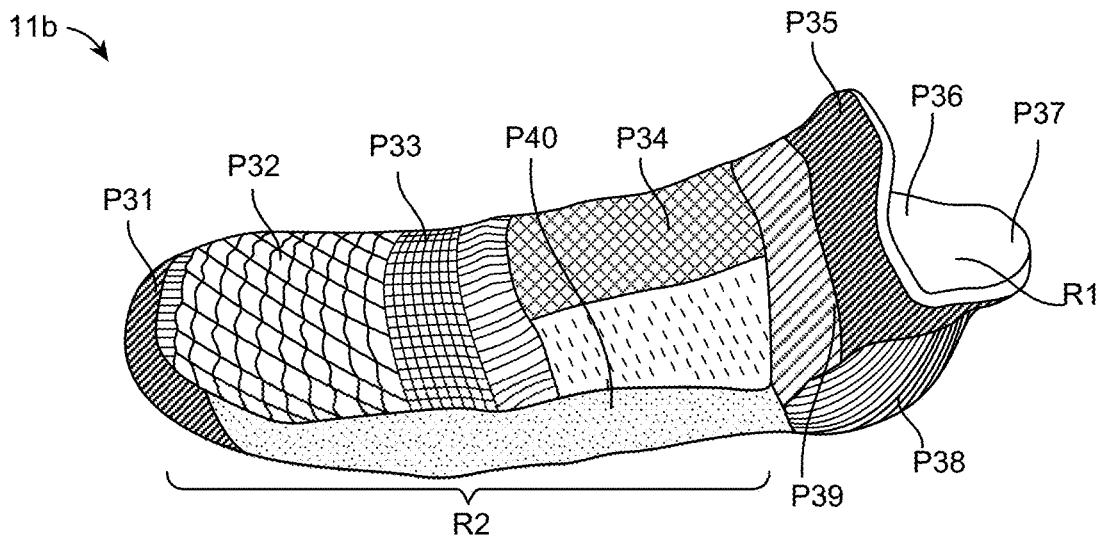

FIGS. 4A, B: another exemplary upper according to the invention.

Figure 5A:
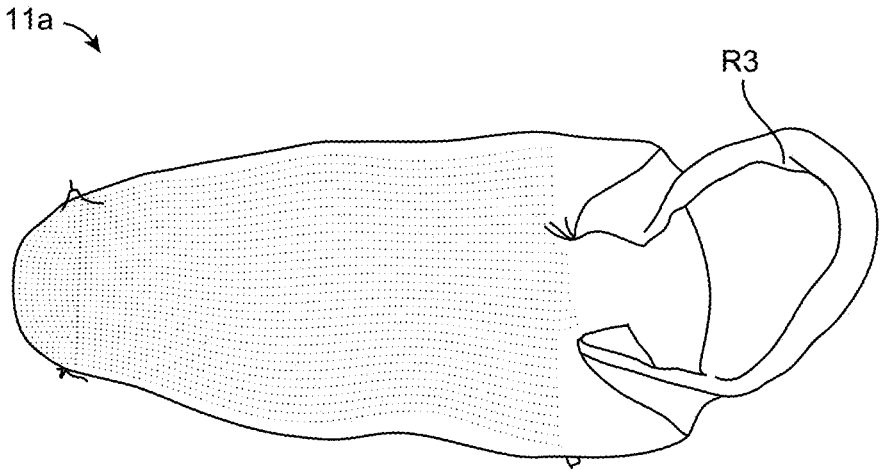
Figure 5B:
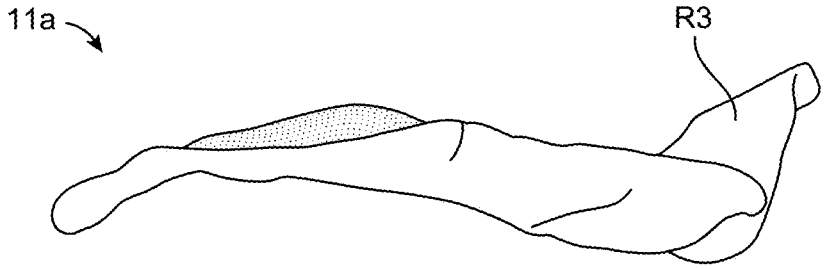
Figure 5C:
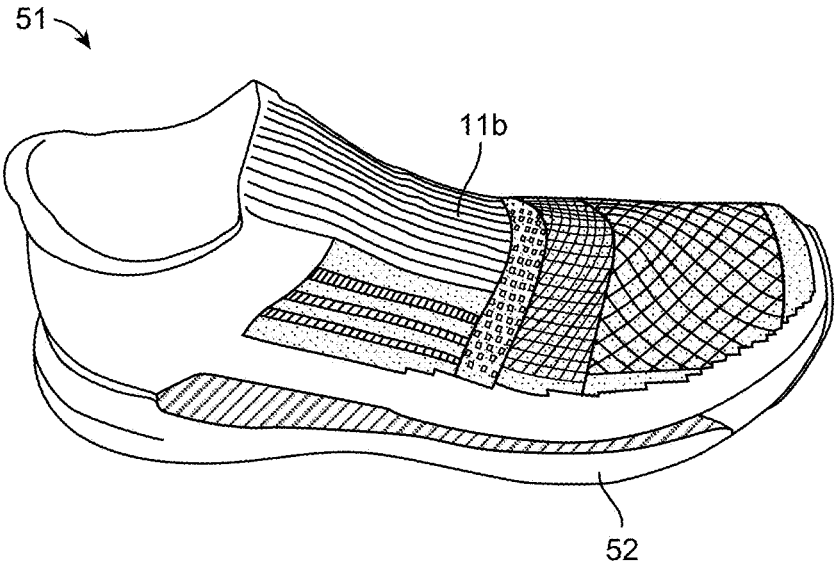

FIGS. 5A-C: an exemplary upper and shoe according to the invention.

Figure 6A:
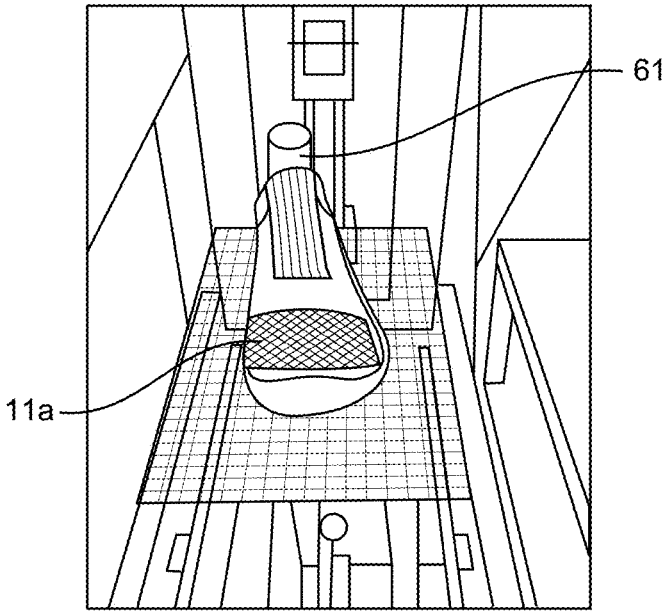
Figure 6B:
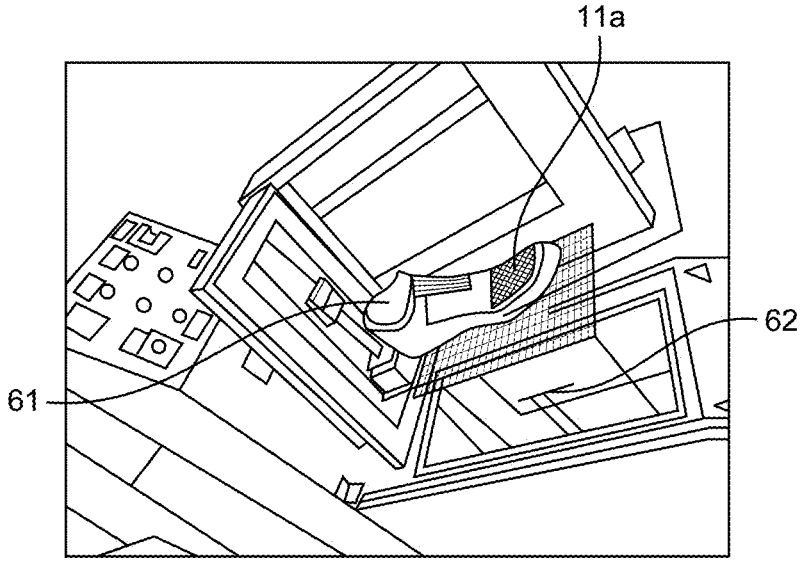
Figure 6C:
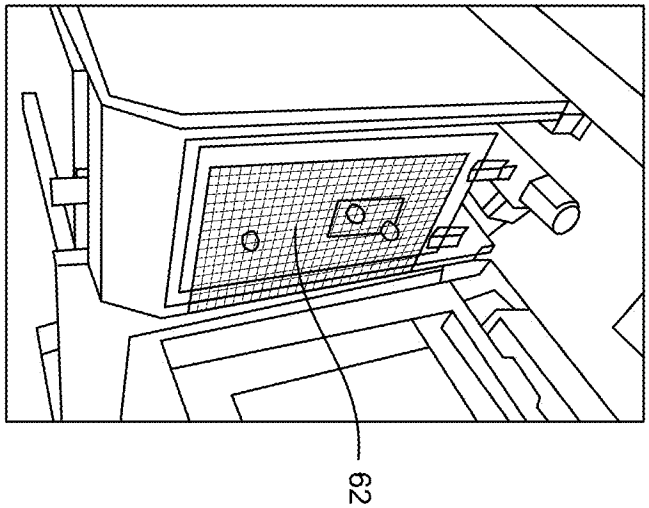

FIGS. 6A-C: an exemplary method of consolidating of the upper according to the invention.

Figure 7A:
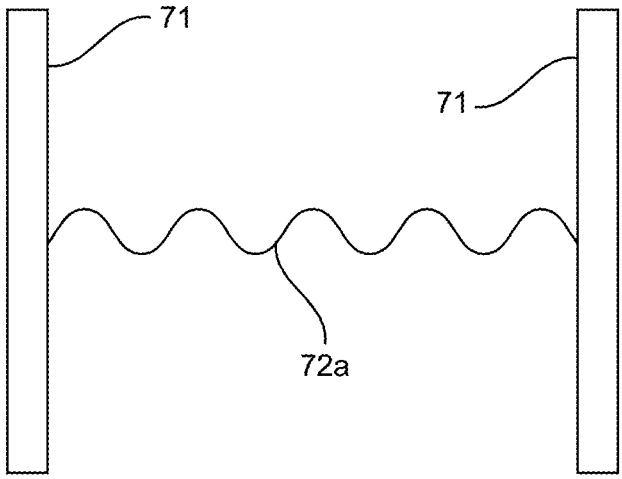

FIGS. 7A, B: an exemplary illustration of a shrink yarn before (7A) and after activation (7B).

Figure 8:
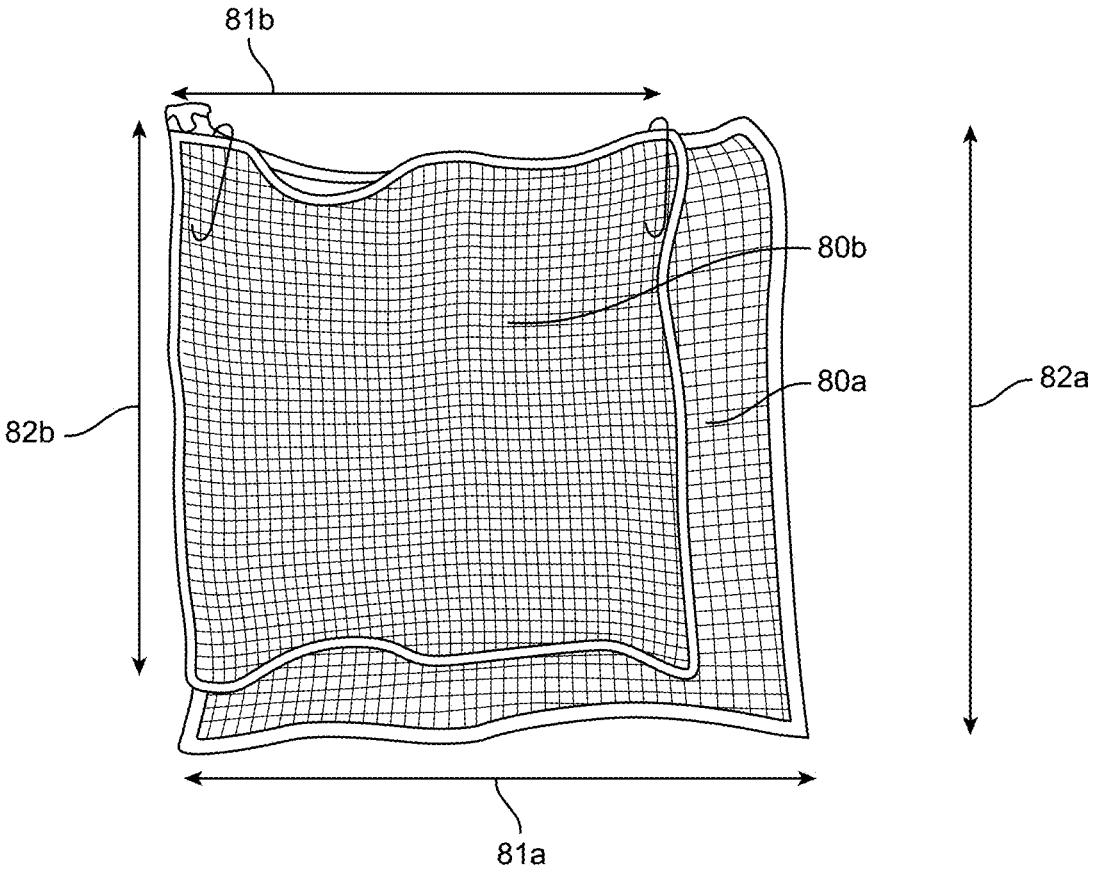

FIG. 8: an exemplary illustration of the shrinkage effected by shrinking yarns in a knitted textile according to the invention.

Figure 9:
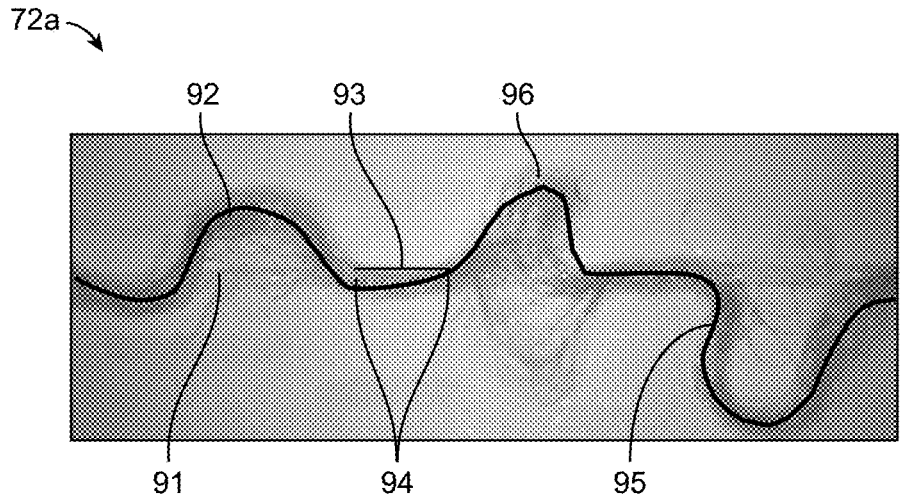

FIG. 9: an exemplary illustration of a shrink yarn.

Figure 10:
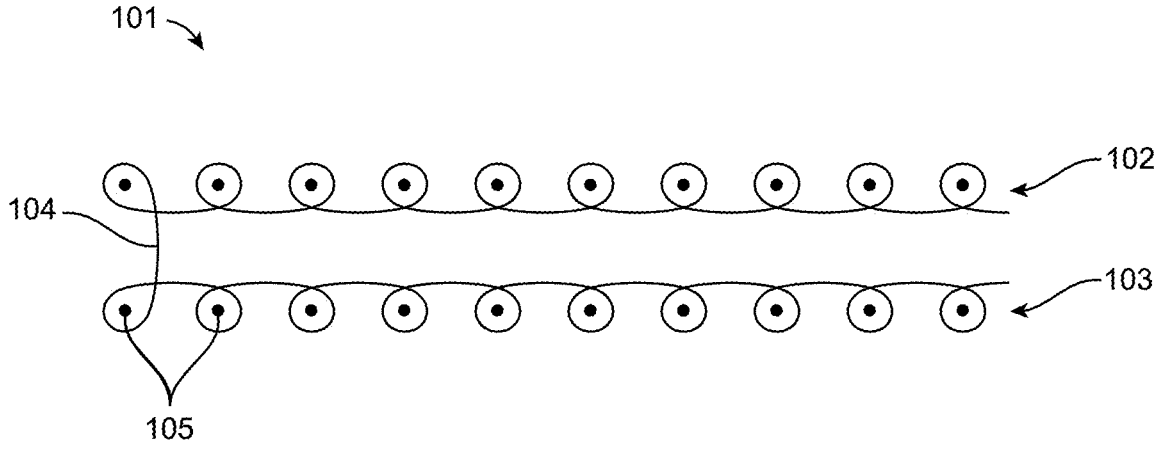

FIG. 10: a transfer between a first and a second needle bed.

Figure 11:
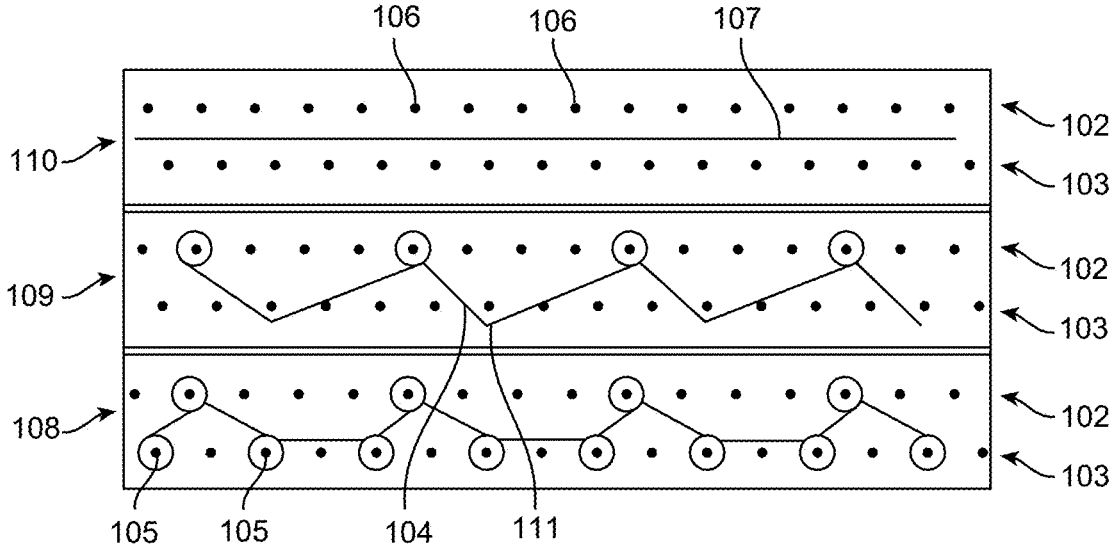

FIG. 11: an exemplary knitting pattern.

Figure 12:
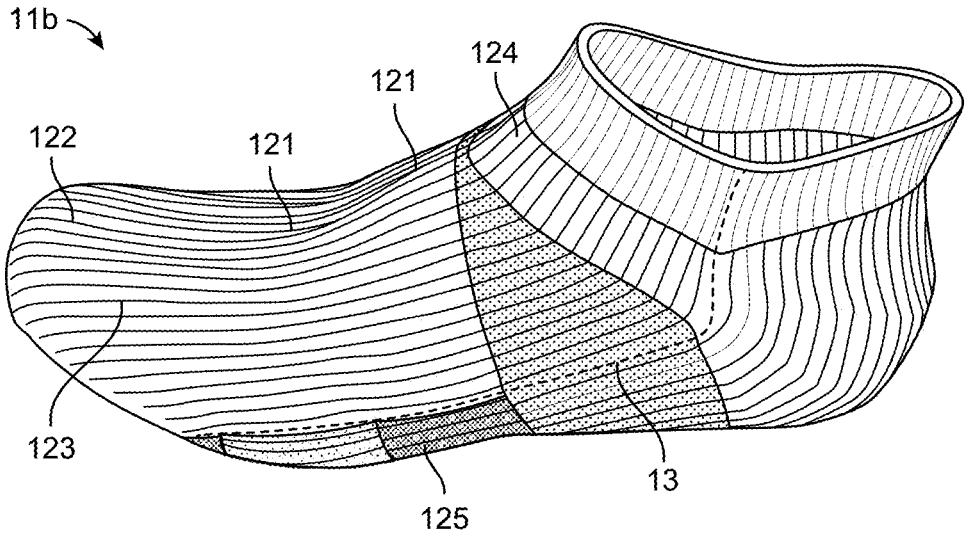

FIG. 12: an exemplary upper according to the invention.

DETAILED DESCRIPTION OF PREFERRED EMBODIMENTS

In the following only some possible embodiments of the invention are described in detail. The person skilled in the art is aware that these possible embodiments can be modified in a number of ways and combined with each other whenever compatible and that certain features may be omitted in so far as they appear dispensable.

FIG. 1A shows an exemplary upper 11*b* according to the invention. The knitted upper 11*b* is for an article of footwear and is formed essentially as a single piece in a three-dimensional knitting process and comprises at least one activated shrink yarn. The upper 11*b* comprises a first region R1 comprising one knitted layer and a second region R2 comprising two knitted layers.

In region R2, the two layers of yarn, or thread, are knitted together and at the same time, as a double layer jacquard. Thus, incorporating more than one layer does not substantially increase the knitting time required. The shown upper is in particular produced by using a flatbed knitting machine comprising two needle beds. The three-dimensional tubular structure comprising the double layer region R2 and the single layer region R1 is obtainable on the two needle beds of the flat knitting machine by alternating the use of the needles. Therefore, on the needle beds each layer is knitted only using a fraction of the needles, for instance knitting each region every second or third needle. This requires yarns, or threads, with sufficient elasticity to ensure a smooth knitted fabric. The amount of elasticity required is dependent on the machine gauge, i.e. the number of needles per inch. For example, with a machine gauge of 14, as suitable choice of yarn could be an air tack yarn comprising 40 to 80 denier elastane, also known as Lycra® or Spandex®, and 150 to 300 denier polyester with between 3 and 5 plies in each thread. Air tack yarn has the usual meaning in this context, that has already been provided above.

However, other types of thread as well as other types of air tack yarn outside of the above range could still be used and possibly yield good results.

Since the second number of knitted layers in region R2 is larger than the first number of knitted layers in region R1, the second region R2 is less elastic, stiffer, stronger and more stable than the first region R1. Of course, the weight per unit area of the second region R2 is generally larger than for region R1, though the exact factor depends also on the choice of yarns.

The first region R1 is preferably located in a bottom region of the upper and/or a heel region of the upper and the second region R2 is preferably located in a top region of the upper.

The bottom region of the upper 11*b* is attached to a sole when an article of footwear is formed from the upper 11*b*. Therefore, the primary element that provides structural stability in the bottom region of the upper 11*b* is the sole. Hence, it is not necessary for the upper 11*b* alone to provide structural support in a bottom region of the upper 11*b*. In order to provide the shoe with a lower weight, while still ensuring the comfort and the performances of an upper which is fully enclosing the foot of the wearer, it is therefore possible to provide the minimum number of layers in a bottom region of the upper 11*b*. For shoes, where additional support of the heel region is required, the sole element may extend upwards into a heel region, or alternatively a heel counter could be provided. Therefore, the same arguments that apply for the bottom portion of the upper 11*b* also apply to the heel region of the upper 11*b* and thus in order to provide a lightweight upper 11*b*, the minimum number of knitted layers in the heel region can be provided.

In the embodiment illustrated in FIG. 1A, the heel region of the knitted upper 11*b* is reinforced by a knitted protrusion that is folded over the heel region doubling the layers of the knitted fabric on the heel region, as better specified later on.

The top portion region of the upper 11*b* does not always benefit from additional structural elements that reinforce the structural stability of an article of footwear comprising an upper 11*b* according to the invention. This is in contrast to the bottom region of the upper which is generally provided with additional stability by the sole. Therefore, the structural stability of the top region of the upper 11*b* needs to be higher than the structural stability of the bottom region of the upper 11*b*. Therefore a larger number of layers could be provided in the top region of the upper 11*b* than in the bottom region of the upper 11*b*. Additional structural elements may however be provided on the top region of the upper, such as for instance lace supports that can be attached to the upper or directly to the sole.

However, either of the regions R1 or R2 may be located anywhere on the upper 11*b* in order to engineer regions of stiffness or flexibility in any part of the upper 11*b*.

The upper 11*b* is formed essentially as a single piece in a three-dimensional knitting process. In this way, the production process is simplified as a single production step can yield a tubular upper capable of enclosing the foot of a wearer and no additional operations, such as for example sewing separate pieces together, are required.

The first region R1 and the second region R2 preferably have a linear extent in all directions on the surface of the upper that is significantly larger than a separation of two adjacent loops along a weft direction. By "significantly larger" it is meant in this context, at least a factor of 3 larger, preferably a factor of 5 larger. In other words, the first region R1 and the second region R2 cover parts of the upper that are significantly larger than the mesh size of the knitted fabric. Therefore, regions of support can be engineered on a scale that is significantly larger than the mesh size of the knitted fabric. This is functional because anatomic features of the foot are significantly larger than a mesh size of the knitted fabric. In order for this to be possible, relatively elastic yarns, or threads, need to be used as disclosed herein.

The knitted upper 11*b* is essentially seamless. The connection lines 12 connecting different regions, portions or parts of the upper 11*b*, that differs for the knit structures, the yarns or the number of layers, are all obtained during the knitting process. A connection line 12 in this context is therefore any linear interface between any two regions, portions or parts comprising different yarns, different numbers of plies and/or a different number of knitted layers and/or a different knitting structure. Various elements, such as for instance reinforcement elements such as pads, trademark elements, identification labels or care labels, may be sewn in and therefore result in a sewn seam. Connection lines 12 have the advantage that they could be formed within the same process step as the rest of the upper is being formed. A separate step in which two or more pieces are sewn together is not required. Furthermore, the wearing comfort is improved as connection lines 12 do not protrude from the fabric as the sewn seams, and no stitching yarn is required which has different, and often less comfortable properties than the fabric.

In region R2, the two layers are preferably interconnected. The stability of the knitted fabric is improved by connecting the layers and the risk of the layers tearing apart is greatly reduced. The layers are preferably connected directly during the knitting process, which has the advantage of forming a very stable connection that does not require any adhesive, shrink yarn, or fuse yarn. However, it is also possible that the layers are connected after the knitting process is completed in a second consolidation step.

The upper 11*b* further comprises at least one activated shrink yarn. A shrink yarn is incorporated in an inactive state into the knitted fabric. In the inactive state the knitted fabric including the shrink yarn has a certain area A1, when the shrink yarn is activated, the knitted fabric obtains a new area A2 which is smaller than A1, that is the knitted fabric reduces its area, i.e. shrinks, when the shrink yarn is activated. Preferably, the knitted fabric including the shrink yarn is capable of shrinking at least 15%, and more preferably at least 30%.

Usually activation happens above a certain threshold temperature by exposing the shrink yarn to dry heat or wet heat. Hot steam is a preferred method of activating a shrink yarn as it penetrates deeply and uniformly into the fabric and the yarn fibers. It also prevents damage to the dyes in the fabric and hence the colors of fabric treated with hot steam have a more appealing visual appearance than the colors of the fabric that is exposed to dry heat at the same temperature. The shrink yarn remains in the activated state, that is the shrunk state, even after cooling down and when it is no longer exposed to heat or heated steam.

The knitted unconsolidated upper is preferably arranged on a last and lasted. The knitted unconsolidated upper may be fixed to the last by any suitable means of fixing in order to prevent an unintended movement of the upper during the lasting operation. For example, the upper may be fixed on the last by means of a clamp or a tack. The upper is then exposed to dry or wet heat while it is arranged on the last. The shrink yarn is activated and thus shrinks and provides a close fit of the upper to the last, even in challenging regions. In case that hot steam is used to activate the shrink yarn, the upper may then be dried, preferably in the controlled environment of a drying oven. The upper is then cooled down and removed from the last. It is also possible to cool the upper on the last first, remove the upper from the last, and then dry the upper after it has been removed from the last. The resulting consolidated upper 11*b* is shown in FIG. 1A and has sufficient permanent rigidity to retain its shape, i.e. it can stand without additional support.

The shrink yarn allows difficult geometric shapes, such as for instance the curvatures at the Achilles tendon or at the toe region, that would be difficult or impossible to obtain in a pure knitting operation, to be formed and consolidated, that is, fixed permanently. The activated shrink yarn also improves the structural strength of the upper in any region into which it has been incorporated.

A shrink yarn also makes it possible to produce up to three adjacent sizes or half sizes of an upper from a single size of a knitted, unconsolidated upper. The sizes can be measured in a UK, US, or European unit system. This simplifies the production process, as a knitted upper and the corresponding knitting model do not have to be generated for every final size of the consolidated upper.

The activated shrink yarn may be arranged at least in a heel and/or a toe portion of the upper 11*b*. The heel and/or toe portion of an upper are, usually, are in fact the most difficult regions to shape. Moreover, a foot requires increased levels of support in the heel and/or the toe region. The heel and/or the toe region are also critical regions that determine how well and comfortably an upper fits a wearer's foot.

The upper 11*b* preferably further comprises at least one melted fuse yarn. A fuse yarn, otherwise known as melt yarn, is any yarn that comprises a meltable, generally thermoplastic, component.

A fuse yarn is a useful means to permanently fix the shape of a shaped upper 11*b*. It also provides additional structural strength in regions where this is required. It is particularly useful to control or limit the shrinkage caused by activating a shrink yarn.

The melted fuse yarn is preferably arranged in a heel and/or a toe portion of the upper. For instance, the fuse yarn may be incorporated in the upper 11*b* on the toe counter region Y8, on the metatarsal region Y3 and on the heel region Y1. The heel and/or toe portion of an upper are, usually, the most difficult regions to shape. Moreover, a foot requires increased levels of support in the heel and/or the toe region.

The upper 11*b* shown in FIG. 1A comprises a third region R3. The third region is formed by knitting a collar in the heel region and extending the collar so that it extends beyond the final shape of the upper. The part of the collar that extends beyond the final shape of the upper is then folded back into the upper in the heel region of the upper. In the lasting and consolidation process described herein, these two parts of the collar are shaped together through the activation of the shrink yarn after folding. The two parts keep in this manner their shape and the relative position also when the upper is removed from the last. Optionally, the two parts can be permanently bonded together either by means of melting of the fuse yarn incorporated in the upper or by means of an adhesive or by sewing. A cushioning or a reinforcing material may also be inserted between the two parts. The heel region thus formed is very stable and provides a good level of support for a wearer's foot. This is also illustrated in FIG. 3A for a further example.

Figure 1B:
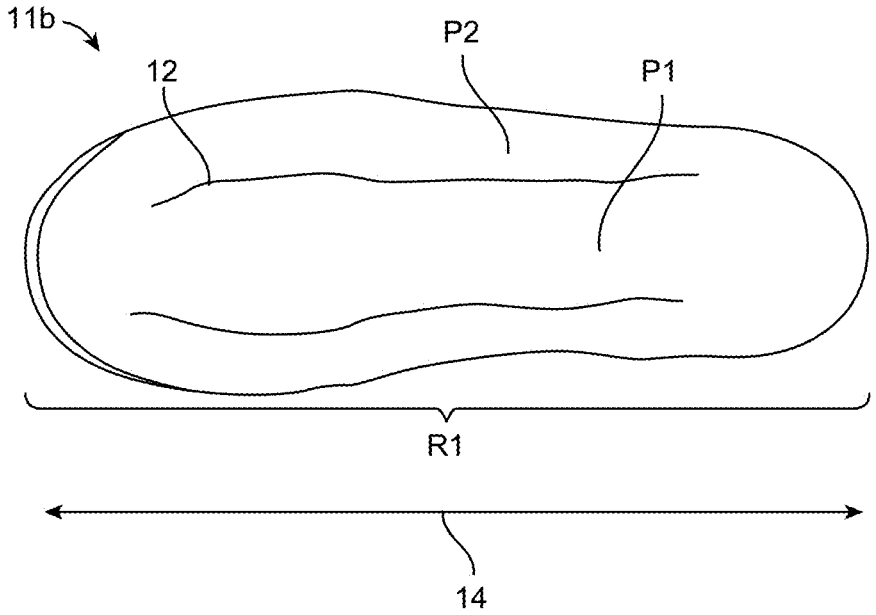

FIG. 1B shows a bottom region of the upper 11*b*. Region R1 of the upper 11*b* comprises two portions, wherein the first portion P1 comprises a thread having a first number of plies and wherein the second portion P2 comprises the same thread having a second number of plies which differs from the first number of plies. This provides an additional way of tuning the properties, in particular the stability, strength, weight, and breathability of the upper 11*b*. Differently than the embodiment illustrated in FIG. 1B where the portions P1 and P2 incorporate the same yarns, the first portion P1 may comprise a thread of a first type and the second portion P2 may comprise a thread of a second type.

The number of plies of the thread of the second portion P2 is greater than the number of plies of the thread of the first portion P1. The advantage is that basic properties of the thread such as its look, the feel, and the friction are the same but an additional level of stability is provided on the second portion P2 due to the larger number of plies. Portion P2 of the fabric knitted with the thread having a greater number of plies will be less elastic and stronger than portion P1 of the fabric knitted with the thread having a lower number of plies.

In the embodiment illustrated in FIG. 1B, the first portion P1 extends along the longitudinal axis of the upper from the toe region to the heel region on a central area of the bottom region. The second portion P2 also extends along the longitudinal axis of the upper from the toe region to the heel region, at the sides of the first portion P1.

The number of plies of the thread on the second portion P2 is preferably at least twice as large as the number of plies of the thread on the first portion P1, for example the thread in region P2 has 2 plies of yarn while the thread in region P1 has 1 ply of the same yarn. The inventors have discovered that this factor in the number of plies of the thread on the second portion P2 and the thread on the first portion P1, provides the thread on the second portion P2 with a preferred level of increased structural strength while at the same time the thread on the first portion P1 is still sufficiently strong, yet lightweight. This way, the rim region where portion P2 is located, which is subject to greater shear stresses and forces when the upper is being worn, is provided with a stronger thread. The central region, where portion P1 is located, which is subject to lower shear stresses and forces when the upper is being worn, is provided with a more lightweight construction.

The upper 11*b* is knitted on a flatbed knitting machine comprising at least two needle beds. A flatbed knitting machine allows a great variety of complex knitting patterns to be incorporated into the knitted fabric. A flatbed knitting machine comprising at least two needle beds allows the upper to be manufactured as one unitary piece in a single knitting operation. Further processing steps, in which separate parts of the fabric have to be sewn together, can therefore be completely avoided. Furthermore, the upper 11*b* so obtained is substantially seamless, which improves the comfort of the upper 11*b*.

When the three-dimensional upper 11*b* is knitted on a flatbed knitting machine comprising two needle beds, according to the tubular knitting technique, during the knitting there is a transfer of yarns from a first needle bed to a second needle bed when changing a knitting stroke direction and such transfer defines, on the finished upper, a parting line 13. In this example, the parting line 13 is arranged between a bottom and a top region of the upper.

A longitudinal direction 14 of the upper is illustrated in FIG. 1B.

Figure 2B:
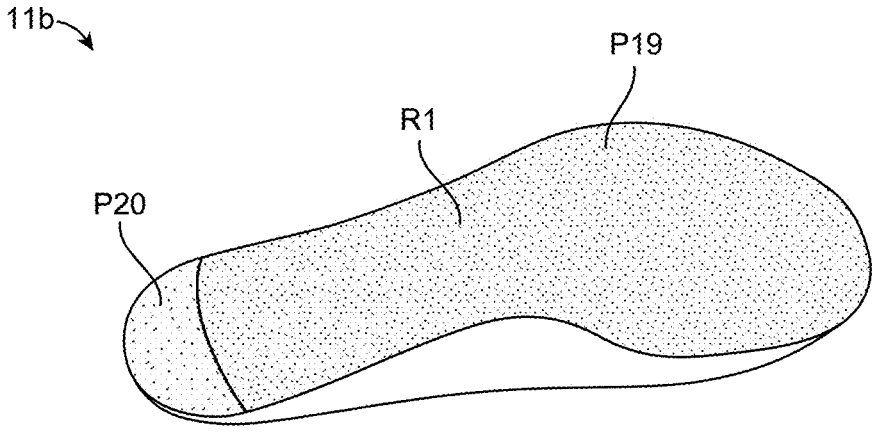

FIGS. 2A, B show another exemplary upper 11*b* according to the invention. The knitted upper 11*b* is for an article of footwear and is formed essentially as a single piece in a three-dimensional knitting process and comprises at least one activated shrink yarn. FIG. 2A shows a top region of the upper 11*b* and FIG. 2B shows a bottom region of the upper 11*b*. The upper 11*b* comprises a first region R1 comprising one knitted layer and a second region R2 comprising two knitted layers.

At least one of the regions preferably comprises two parts, wherein the first part comprises a first knitting structure and the second part comprises a second knitting structure. The terms knitting structure and knitting patterns are used interchangeably. A knitting structure is, for example, plain, interlock, jersey, purl, rib knit, Milanese, Raschel, or tricot. These terms have their usual meaning. For example, interlock is a stitch in which loops of a first course are situated on every other wale, e.g. wale 1, 3, 5, etc. Loops of the next course, the second course, are situated on the wales skipped in the first course, e.g. 2, 4, 6, etc. Front and back of the interlock fabric look identical. The surface is smooth and soft to touch and the resulting fabric is strong and wear resistant.

The embodiment illustrated in FIG. 2A, for instance, comprises a first part P11 on the instep region having a rib structure for enhancing the stretchability, a second part P12 surrounding the instep region and having a plain fabric structure for enhancing the stability and a third part P13 on the forefoot region having an open structure provided with a plurality of apertures for enhancing the breathability.

The first part P11 may further comprise a plurality of elastic inlays that are incorporated in the knitted structure to improve the fitting of the upper on the foot of a wearer.

This is an additional way of tuning the properties, in particular the elasticity, stability, strength, weight, and breathability of the upper. It has the advantage that the same yarn and the same number of plies may be used for both of the two portions, which is important because the number of different types of yarn or plies is limited by the number of yarn carriers. However, it is also possible that different types of yarn or yarns with different number of plies are used for the two parts.

The upper 11*b* preferably further comprises at least one melted fuse yarn. A fuse yarn, otherwise known as melt yarn, is any yarn that comprises a meltable component.

A fuse yarn is a useful means to permanently fix the shape of a shaped upper 11*b*. It also provides additional structural strength in regions where this is required. It is particularly useful to control or limit the shrinkage caused by activating a shrink yarn. It is, for example, possible that no shrinkage is desired at all in certain portions of the upper, where fixation and additional structural support are nonetheless required.

The melted fuse yarn is preferably arranged in a heel and/or a toe portion of the upper. The heel and/or toe portion of an upper are, usually, the most difficult regions to shape. Moreover, a foot requires increased levels of support in the heel and/or the toe region.

A summary of the different knitting structures used for the upper 11*b* shown in FIGS. 2A, B is given in Table 1. The terms have their usual meaning unless mentioned otherwise.

TABLE 1

| Portion | Description |
|---|---|
| P11 | Elastic inlay, double layer Jacquard |
| P12 | Double layer, plain structure |
| P13 | Double layer, open structure |
| P14 | Single layer plain structure |
| P15 | Single layer, plain structure |
| P16 | Single layer, 1 × 1 interlock |
| P17 | Single layer, 1 × 1 interlock |
| P18 | Single layer, mirrored collar, plain structure |
| P19 | Single layer, plain structure |
| P20 | Single layer, 1 × 1 interlock |

Figure 3B:
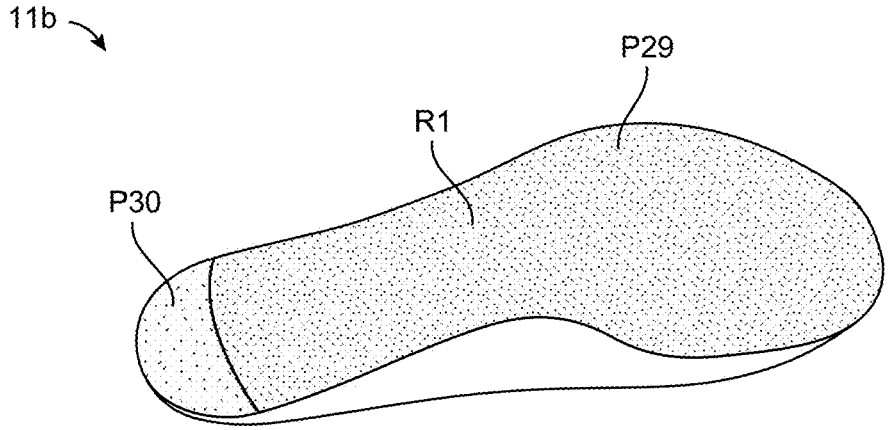

FIGS. 3A, B show another exemplary upper 11*b* according to the invention. The knitted upper 11*b* is for an article of footwear and is formed essentially as a single piece in a three-dimensional knitting process and comprises at least one activated shrink yarn. FIG. 3A shows a top region of the upper 11*b* and FIG. 3B shows a bottom region of the upper 11*b*. The upper 11*b* comprises a first region R1 comprising one knitted layer and a second region R2 comprising two knitted layers.

The upper 11*b* shown in FIGS. 3A, B comprises a folded collar 23 in the heel region. The collar is produced by knitting and extending the collar so that it extends beyond the final shape of the upper. The part 22 of the collar that extends beyond the final shape of the upper is then folded back into the upper in the heel region of the upper. In the lasting and consolidation process described herein, the two parts of the collar are shaped through the activation of the shrink yarn after folding. The two parts of the collar can moreover be bonded in the same lasting and consolidation process through the activation of the fuse yarn or, in a subsequent process step, through gluing or stitching. The heel region thus formed is very stable and provides a good level of support for a wearer's foot.

A summary of the different knitting structures and yarns used for the upper 11*b* shown in FIGS. 3A, B is given in Table 2. The notation is the same as used for the other tables herein.

TABLE 2

| Portion | Description |
|---|---|
| P21 | Double layer Jacquard, rib structure with inlay |
| P22 | Double layer Jacquard, plain structure |
| P23 | Double layer Jacquard, open structure |
| P24 | Single-layer, plain structure |
| P25 | Single-layer, plain structure |
| P26 | Single-layer, 1 × 1 interlock |
| P27 | Single-layer, 1 × 1 interlock |
| P28 | Mirrored and folded collar, single layer, plain structure |
| P29 | Single layer, plain structure |
| P30 | Single layer, 1 × 1 interlock |

Figure 4B:
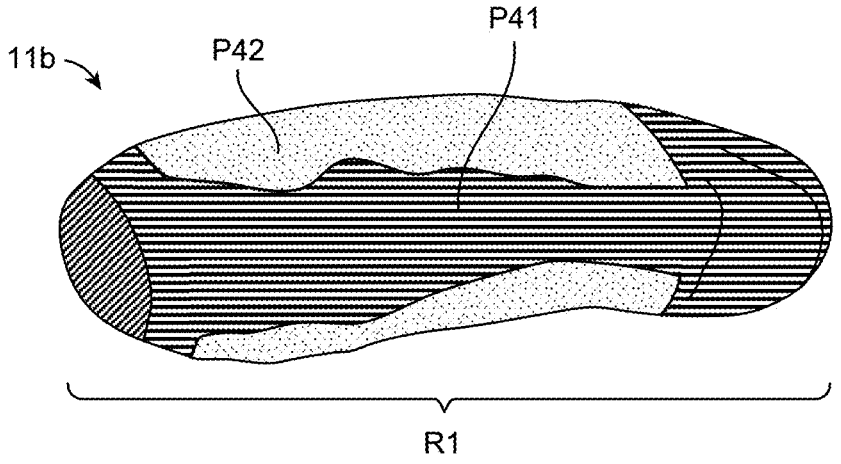

FIGS. 4A, B show another exemplary upper 11*b* according to the invention. FIG. 4A shows a top region of the upper 11*b* and FIG. 4B shows a bottom region of the upper 11*b*. The upper 11*b* comprises a first region R1 comprising one knitted layer and a second region R2 comprising two knitted layers. In particular, the first region R1 comprises a central area P41, incorporating a first yarn and extending centrally from the toe region to the heel region, and a side areas, incorporating a second yarn and extending longitudinally at the sides of the central area P41. The second yarn has a greater number of plies than the first yarn.

The upper 11*b* shown in FIGS. 4A, B comprises a folded collar P36 in the heel region.

FIGS. 5A-C show a further embodiment of a knitted upper 11*a* and shoe according to the present invention. FIG. 5A shows a top view and FIG. 5B shows a lateral view of the knitted upper 11*a* in a flat state immediately after knitting. The upper 11*a* is knitted on a flatbed knitting machine comprising at least two needle beds.

The upper 11*a* shown in FIGS. 5A and 5B comprises a third region R3 that is formed by knitting a collar in the heel region and extending the collar so that it extends beyond the final shape of the upper. The part of the collar that extends beyond the final shape of the upper is then folded back into the upper in the heel region of the upper, as described above for the upper of FIG. 1A.

The knitted unconsolidated upper 11*a* is then arranged on a last and lasted (step not shown). The upper is then exposed to heat or heated steam while it is arranged on the last. The shrink yarn is activated and thus shrinks and provides a close fit of the upper to the last, even in challenging regions. The fuse yarn is melted. In this example, steam is used to activate the shrink yarn and the upper may be dried in the controlled environment of a drying oven. The upper is then cooled down and removed from the last. The resulting upper has a set shape and form that provides an excellent fit to a foot.

In a further process step, a sole 52 is attached to the consolidated upper 11*b*, resulting in the shoe 51 shown in FIG. 5C.

The upper according to the invention may comprise holes for shoe laces. The holes can be integrally formed within a single knitting process. No additional sewing or re-enforcement of the region around the holes is required.

FIG. 6A shows an exemplary unconsolidated upper 11*a* arranged on a shoe last 61. The upper 11*a* is preferably fixed to the last 61 with a means of fixing. The knitted unconsolidated upper 11*a* may be fixed to the last by any suitable means of fixing in order to prevent an unintended movement of the upper during the lasting operation and/or during the subsequent heat treatment. For example, the upper may be fixed on the last by means of a clamp or a tack.

FIG. 6B shows how the upper 11*a* arranged on the last 61 is inserted into a chamber 62. The chamber is then closed as shown in FIG. 6C and the upper 11*a* is heated. The shrink yarn is activated and thus shrinks while the upper is on the last and therefore facilitates a close fit of the upper to the last, even in challenging regions. The fuse yarn is melted. The upper 11*a* is then cooled down to consolidate the lasted shape and then removed from the last 61. The fuse yarn is preferably melted in the same process step as the shrink yarn is activated to reduce the number of process steps. However, it is possible that the operations of melting the fuse yarn and activating the shrink yarn are performed separately, for example, if the activation temperature of the shrink yarn is different to the melting temperature of the fuse yarn. This may be beneficial to allow a partial consolidation of the upper 11*a* and further processing steps.

Heating the upper 11*a* on the last 61 is preferably performed using hot steam in a steaming chamber 62. In this case, an additional step of drying the upper 11*b* may be performed, preferably in the controlled environment of a drying oven. It is also possible to cool the upper 11*a* on the last 61 first, remove the upper 11*b* from the last 61, and then dry the upper 11*b* after it has been removed from the last 61. It is also possible that the upper 11*b* is dried while it is still on the last, either before a first cool down or after it has cooled down once or several times already. Hot steam is a preferred method of activating a shrink yarn as it penetrates deeply and uniformly into the fabric. It also prevents damage to the dyes in the fabric and hence the colors of fabric treated with hot steam have a more appealing visual appearance than the colors of the fabric that is exposed to dry heat at the same temperature.

Figure 7B:
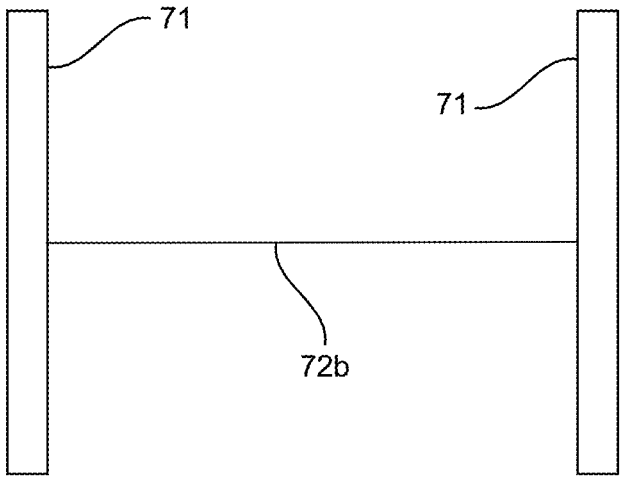

FIGS. 7A, B illustrate the behavior of a shrink yarn 72. FIG. 7A shows an inactive shrink yarn 72*a* before it is activated. The shrink yarn is held fixed at both ends by a suitable construction 71. FIG. 7B shows the activated shrink yarn 72*b* after it has been activated as described herein. The shrink yarn has shrunk and is now under tension.

The use of a shrink yarn, especially in combination with a lasting operation, allows even difficult geometric shapes, that would be difficult or impossible to obtain in a pure knitting operation, to be formed and consolidated, that is, fixed permanently. The activated shrink yarn and the melted and solidified fuse yarn also improves the structural strength of the upper in any region into which it has been incorporated.

A shrink yarn also makes it possible to produce up to three adjacent sizes or half sizes of an upper from a single size of a knitted, unconsolidated upper. This simplifies the production process, as a knitted upper and the corresponding knitting model do not have to be generated for every final size of the consolidated upper.

FIG. 8 shows an exemplary knitted textile for an upper according to the present invention. The knitted textile is shown prior 80*a* to activating the shrinking yarn and after 80*b* activating the shrinking yarn. Prior 80*a* to activating the shrinking yarn the knitted textile has a width 81*a* of 150 mm and a height 82*a* of 155 mm and therefore an area of 23,250 square millimeters. After 80*b* activating the shrinking yarn the knitted textile has a width 81*b* of 125 mm and a height 82*b* of 130 mm and therefore an area of 16,250 square millimeters. The area of the knitted textile is therefore shrunk by 30% by activating the shrinking yarn.

The knitted textile has a width of 150 needles per course and a length of 160 wales. The yarn used comprises air tack yarn comprising four plies of 150 denier polyester yarn and 40 denier elastane yarn. Moreover, a filament single ply 600 denier polyester yarn is used.

FIG. 9 illustrates an exemplary air tack yarn 72*a* suitable for an upper and a method for production thereof according to the present invention. The exemplary air tack yarn 72*a* comprises a filament yarn 92 comprising polyester and having a plurality of filament fibers 96 and an elastane strand 91. A tacking width 93 is given by the separation of adjacent tacking point 94. A strong air tack yarn results from a tacking width 93 of between 3 and 20 mm, preferably between 5 and 15 mm, measured when the elastane strand is relaxed. A yarn crimp is illustrated with reference numeral 95. Yarn crimp in %=(straightened yarn length−relaxed yarn length)/(straightened yarn length)×100. Preferably, yarn crimp is in the range between 20% and 100% in order to provide advantageous shrinking properties and sufficient stability. In this example, the denier ratio between polyester yarn and elastane yarn is 3.75:1. There are between 24 and 1152 filament fibers per polyester yarn.

FIG. 10 illustrates the transfer 104 of yarn between a first needle bed 102 and a second needle bed 103 during a knitting operation on a flat knitting machine. When the three-dimensional upper is knitted on a flatbed knitting machine comprising two needle beds, according to the tubular knitting technique, during the knitting there is a transfer 104 of yarns from a first needle bed to a second needle bed when changing a knitting stroke direction and such transfer 104 defines, on the finished upper, a parting line. The top indicates the stitches created on the first needle bed 102 with a first stroke, from right to left, and the bottom indicates the stitches created on the second needle bed 103 with a second stroke from left to right. Reference numeral 105 indicates needles knitting.

FIG. 11 illustrates an exemplary simplified knitting sequence for knitting a part or a portion of an upper according to the present invention, in particular comprising a double layer jacquard on the top and/or on the bottom layer. The exemplary knitting sequence is for knitting on a flatbed knitting machine comprising a first 102 and a second 103 needle bed. Reference numeral 105 generally indicates needles knitting, reference numeral 104 indicates a spacer structure.

At the bottom 108, the sequence illustrates how a top layer is knitted. The top layer is knitted using needles of both needle beds. The spacer sequence 104 is added to tighten the knitting structure of the top or bottom layer that is being knitted.

Reference numeral 111 indicates a tuck stitch.

At the top, an inlay portion is illustrated. The needles 106 on the first 102 and the second 103 needle bed are not knitting. Reference numeral 107 indicates the inlaid yarn.

In order to further knit the bottom layer, part of the needles on the front and back needle beds that have been used to knit the top layer need to be freed. This is realized by means of transfers (not illustrated) of part of the knitted stitches from the back to the front needle bed or vice versa before proceeding knitting the bottom layer.

FIG. 12 shows another exemplary upper 11*b* according to the present invention. In particular, the exemplary upper 11*b* comprises two knitted layers 123 all over the upper 11*b*. Moreover, the exemplary upper 11*b* comprises a Jacquard knit portion 122 and an engineered amount of stretch in a metatarsal region 121. The exemplary upper 11*b* also comprises a parting line 13, as described herein. Knitted portion 125 provides an interesting perceived transparency, while silhouette portion 124 allows a good level of breathability.

Some embodiments described herein relate to a knitted upper for an article of footwear formed essentially as a single piece in a three-dimensional knitting process and including at least one activated shrink yarn.

In any of various embodiments described herein, the knitted upper may further include at least one melted fuse yarn. In some embodiments, the melted fuse yarn may be arranged in a heel and/or toe portion of the upper.

In any of various embodiments described herein, the upper may be produced on a flatbed knitting machine comprising at least two needle beds.

In any of various embodiments described herein, the knitted upper includes a first region having a first number of knitted layers, and a second region having a second number of knitted layers, wherein the second number of knitted layers is larger than the first number of knitted layers. In some embodiments, the first region and/or the second region have a linear extent in all directions on the surface of the upper that is significantly larger than a separation of two adjacent loops along a course direction. In some embodiments, in any region having a number of layers greater than one, the layers may be interconnected. In some embodiments, at least one of the first region and the second region has at least two portions, wherein a first portion includes a yarn of a first type and the second portion includes a yarn of a second type.

In any of various embodiments described herein, the knitted upper may include at least a first yarn and a second yarn, and a number of plies of the second yarn is greater than a number of plies of the first yarn. In some embodiments, the number of plies of the second yarn is at least twice as large as the number of plies of the first yarn.

In any of various embodiments described herein, at least one of the first region and the second region includes at least two parts, wherein a first part includes a first knitting structure and a second part includes a second knitting structure.

In any of various embodiments described herein, the activated shrink yarn may be arranged at least in the first region.

Some embodiments described herein relate to a method of producing a knitted upper for an article of footwear that includes knitting at least one activable shrink yarn into the upper, knitting the upper essentially as a single piece in a three-dimensional knitting process, arranging the knitted upper on a shoe last, and activating the shrink yarn.

In any of various embodiments described herein, the activable shrink yarn may include at least one air-tack yarn.

In any of various embodiments described herein, the activable shrink yarn may be arranged in a heel and/or a toe portion of the upper.

In any of various embodiments described herein, at least one fuse yarn may be arranged in a heel and/or a toe portion of the upper.

In any of various embodiments described herein, the method of producing a knitted upper may further include knitting a first region comprising a first number of knitted layers, and knitting a second region comprising a second number of knitted layers, wherein the second number of knitted layers is larger than the first number of knitted layers. In some embodiments, the first region and/or the second region have a linear extent in all directions on the surface of the upper that is significantly larger than a separation of two adjacent loops along a course direction.

In any of various embodiments described herein, the method of producing a knitted upper may further include interconnecting the layers in any region comprising a number of layers greater than one.

In any of various embodiments described herein, the first region may be at least partially located in a bottom region of the upper and/or a heel region of the upper and the second region may be located in a top region of the upper.

In any of various embodiments described herein, at least one of the first region and the second region may include at least two portions, wherein a first portion includes a yarn of a first type, and wherein a second portion includes a yarn of a second type.

In any of various embodiments described herein, at least a first yarn and a second yarn may be knitted into the upper, wherein a number of plies of the second yarn is greater than a number of plies of the first yarn. In some embodiments, the number of plies of the second yarn may be at least twice as large as the number of plies of the first yarn.

In any of various embodiments described herein, at least one of the first region and the second region includes at least two parts, wherein the first part includes a first knitting structure and the second part includes a second knitting structure.

In any of various embodiments described herein, the first region includes one knitted layer and the second region includes two knitted layers.

In any of various embodiments described herein, the method of producing a knitted upper includes knitting at least two uppers simultaneously on the same knitting machine.

What is claimed is:

1. A three-dimensionally knitted upper for an article of footwear comprising:

a first region forming a bottom portion of the knitted upper, wherein the bottom portion is configured to attach to a sole of the article of footwear; and a second region comprising:

a first part comprising a first knitting structure comprising ribs, wherein the first part is an instep region, and wherein each rib extends along a longitudinal axis of the knitted upper in a heel to toe direction, a second part comprising a second knitting structure different from the first knitting structure, wherein the second region is an upper portion of the knitted upper, wherein the knitted upper is a single piece.

2. The knitted upper of claim 1, wherein the second part is a heel region.

3. The knitted upper of claim 2, further comprising:

at least one activated shrink yarn, wherein the at least one activated shrink yarn is knitted into at least one of a forefoot region or the heel region.

4. The knitted upper of claim 1, wherein the second part is a part surrounding the instep region.

5. The knitted upper of claim 1, wherein the second region further comprises a third part, the third part comprising a third knitting structure different from the first knitting structure and the second knitting structure.

6. The knitted upper of claim 5, wherein the second part is a part surrounding the instep region, and wherein the third part is a forefoot region.

7. The knitted upper of claim 1, wherein the first region comprises a first number of knitted layers, wherein the second region comprises a second number of knitted layers, and wherein the first number of knitted layers is greater than the second number of knitted layers.

8. The knitted upper of claim 1, wherein the first region, the first part of the second region, and the second part of the second region comprise different numbers of knitted layers.

9. The knitted upper of claim 1, wherein the first part comprises a yarn of a first type, and wherein the second part comprises a yarn of a second type different from the first type.

10. The knitted upper of claim 9, wherein the yarn of the first type comprises a first number of plies, and wherein the yarn of the second type comprises a second number of plies different from the first number of plies.

11. The knitted upper of claim 9, wherein the yarn of the first type comprises a first thickness, and wherein the yarn of the second type comprises a second thickness different from the first thickness.

12. The knitted upper of claim 9, wherein the yarn of the first type comprises a first denier, and wherein the yarn of the second type comprises a second denier different from the first denier.

13. The knitted upper of claim 1, comprising elastic inlays incorporated into the second knitting structure.

14. The knitted upper of claim 1, wherein the second part is a forefoot region and comprises an open structure.

* * * * *